US006951292B2

(12) United States Patent
Bando et al.

(10) Patent No.: US 6,951,292 B2
(45) Date of Patent: Oct. 4, 2005

(54) CONTAINER WITH A HINGED LID

(75) Inventors: Takeshi Bando, Kanonji (JP); Yoshikazu Tanaka, Kanonji (JP); Katsumi Kameda, Shinjuku-Ku (JP); Masaho Hayashi, Shinjuku-Ku (JP); Norikazu Shinogi, Shinjuku-Ku (JP)

(73) Assignees: Uni-Charm Corporation, Kawanoe (JP); Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 09/319,741

(22) PCT Filed: Oct. 22, 1999

(86) PCT No.: PCT/JP98/04629

§ 371 (c)(1),
(2), (4) Date: Jun. 11, 1999

(87) PCT Pub. No.: WO99/19227

PCT Pub. Date: Apr. 22, 1999

(65) Prior Publication Data

US 2002/0017522 A1 Feb. 14, 2002

(30) Foreign Application Priority Data

Oct. 15, 1997 (JP) ..... 9-282148
Jul. 14, 1998 (JP) ..... 10-199310

(51) Int. Cl.[7] ..... B65D 43/16; B65D 43/22; B65D 45/18; B65D 51/18

(52) U.S. Cl. ..... 220/254.5; 220/254.3; 220/254.7; 220/326; 220/617; 220/829; 220/835; 220/840; 221/48; 221/61; 221/281

(58) Field of Search ..... 220/254.1, 254.3, 220/254.5, 254.7, 281, 326, 829, 836, 840, 835, 827, 617, 254, 229, 831, 833, 834, 916; 221/48, 61, 281, 33

(56) References Cited

U.S. PATENT DOCUMENTS

| | | | | | |
|---|---|---|---|---|---|
| 3,905,356 | A | * | 9/1975 | Fletcher et al. | 220/323 |
| 3,967,756 | A | * | 7/1976 | Barish | 221/45 |
| 3,982,659 | A | | 9/1976 | Ross | |
| 3,986,479 | A | | 10/1976 | Bonk | |
| 4,741,452 | A | * | 5/1988 | Holzkopf | 220/783 |
| 4,887,747 | A | * | 12/1989 | Ostrowsky et al. | 220/832 |
| 5,145,088 | A | * | 9/1992 | Goujon | 220/837 |
| 5,353,946 | A | * | 10/1994 | Behrend | 220/326 |
| 5,582,314 | A | * | 12/1996 | Quinn et al. | 220/326 |
| 5,699,912 | A | * | 12/1997 | Ishikawa et al. | 220/281 |
| 5,887,744 | A | * | 3/1999 | Mejias | 220/284 |
| 5,975,346 | A | * | 11/1999 | Imperato et al. | 220/831 |

FOREIGN PATENT DOCUMENTS

| | | |
|---|---|---|
| EP | 0 950 615 A1 | 10/1999 |
| ES | 1 035 583 | 5/1997 |
| JP | 50-154329 | 12/1975 |

(Continued)

*Primary Examiner*—Jes F. Pascua
*Assistant Examiner*—Niki M. Eloshway
(74) *Attorney, Agent, or Firm*—Oliff & Berridge, PLC

(57) ABSTRACT

A container (10) with a hinged lid comprises a container body (11), a hinged lid (23) hinged on the container body (11), and a bottom wall (12) tightly covering the open lower end of the container body (11). A rubber plate 50) is provided between the hinged lid (23) and the container body (11). The container body (11) has an upper wall (27) provided with an opening (24), and a side wall (13). The hinged lid (23) is supported on the side wall (13) of the container body (11). Since the hinged lid (23) is supported on the side wall (13), the hinged lid (23) can be formed in a large shape. The container body (11) is provided with a catching projection (33) for catching a locking projection (32) formed on the hinged lid (23).

33 Claims, 21 Drawing Sheets

FOREIGN PATENT DOCUMENTS

| | | |
|---|---|---|
| JP | 53-28043 | 3/1978 |
| JP | 54-106940 | 7/1979 |
| JP | 54-123941 | 8/1979 |
| JP | 55-29485 | 3/1980 |
| JP | 57-118795 | 7/1982 |
| JP | 61-147751 | 9/1986 |
| JP | 62-4212 | 1/1987 |
| JP | 63-192292 | 12/1988 |
| JP | 2-1376 | 1/1990 |
| JP | 2-31840 | 2/1990 |
| JP | 4-117722 | 10/1992 |
| JP | 8-80980 | 3/1996 |
| JP | 9-58725 | 3/1997 |

* cited by examiner

CONTAINER WITH A HINGED LID

TECHNICAL FIELD

The present invention relates to a container with a hinged lid capable of being easily opened and closed.

BACKGROUND ART

A container containing articles, such as wet tissues, is provided with an opening through which the wet tissues are taken out, and a hinged lid for tightly covering the opening.

Such a container comprises a container body containing wet tissues and provided with an opening, and a hinged lid for tightly covering the opening.

When using the wet tissues, the hinged lid is removed from the opening of the container body to open the opening, and the wet tissues are taken out one at a time from the container body through the opening.

The container comprises, as mentioned above, the container body and the hinged lid hinged for turning to the container body. When using the wet tissues, the hinged lid is turned for opening and closing the opening.

It is convenient if the hinged lid can surely be opened by a single lid opening action. If the hinged lid can be formed in a large shape, the opening of the container body can be formed in a large size accordingly, and the large opening facilitates taking the wet tissues out of the container body through the opening.

DISCLOSURE OF THE INVENTION

Accordingly, it is an object of the present invention to provide a container with a hinged lid provided with a hinged lid capable of being easily and surely opened and of being formed in a large shape.

According to one aspect of the present invention, a container with a hinged lid comprises a container body having an upper wall provided with an opening, and a side wall extending down from the upper wall, and having open lower end; a hinged lid hinged on the side wall of the container body and capable of tightly covering the opening; and a bottom wall tightly covering the open lower end of the side wall; in which a hinge part connecting the hinged lid to the container body is provided with an elastic biasing means for biasing the hinged lid in an opening direction, the hinged lid is provided on its free end edge with a locking means or part, and the container body is provided with a latching or catching part capable of catching the locking part.

According to the present invention, the hinged lid is opened by the elastic biasing member when the locking part is released from the catching part. The hinged lid supported on the side wall of the container body can be formed in a shape larger than a shape in which the hinged lid can be formed when the hinged lid is supported on the upper wall of the container body.

BEST MODE FOR CARRYING OUT THE INVENTION

First Embodiment

Figure 1:
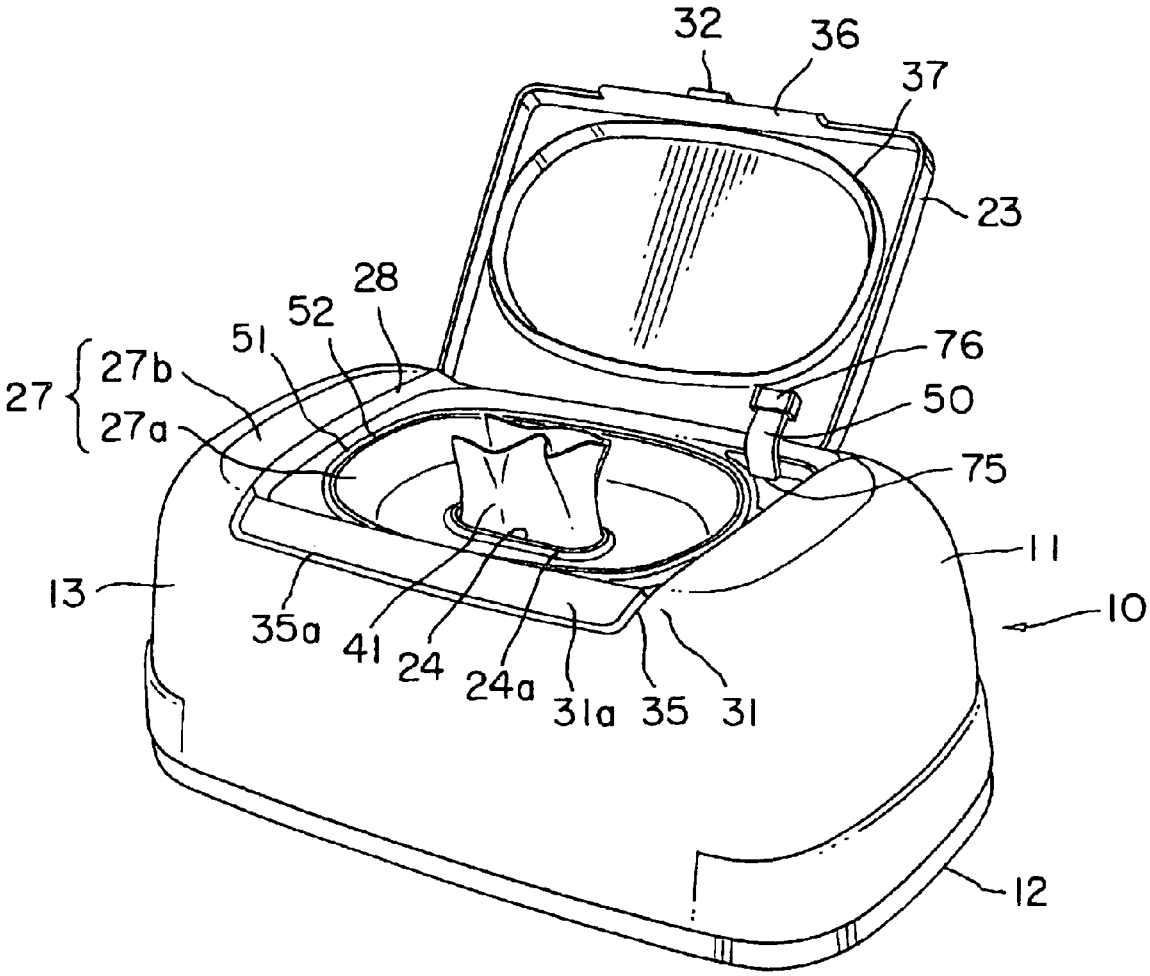
FIG. 1 is a perspective view of a container with a hinged lid in a first embodiment according to the present invention.
Figure 2:
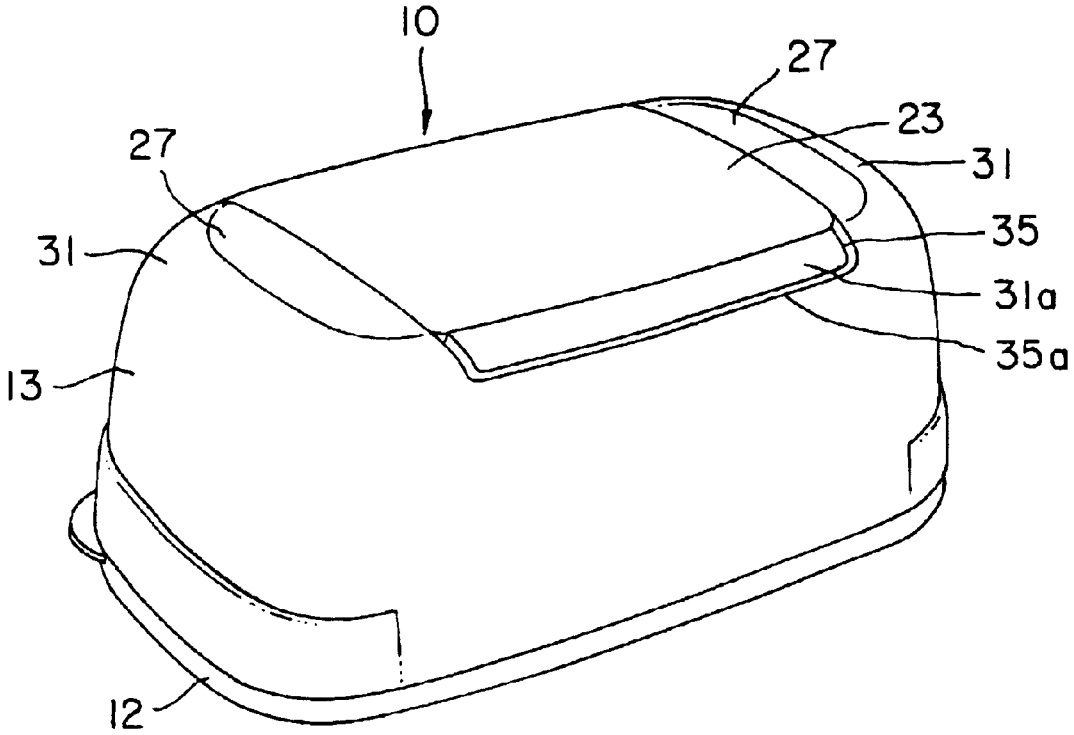
FIG. 2 is a perspective view of the container with a hinged lid shown in FIG. 1 in a closed state.

Preferred embodiments of the present invention will be described with reference to the accompanying drawings. A container with a hinged lid in a first embodiment according to the present invention is illustrated in FIGS. 1 to 8.

Referring to FIGS. 1 to 8, a container 10 (container with a hinged lid) comprises a container body 11 containing wet tissues 41 (FIG. 4) and having an open lower end, and a bottom wall 12 covering the open lower end of the container body 11. The container body 11 has an upper wall 27 provided with an opening 24, and a side wall 13 extending down from the upper wall 27. A hinged lid 23 is swingably supported on the side wall 13 of the container body 11. The hinged lid 23 is capable of tightly covering the opening 24 of the upper wall 27.

Figure 5:
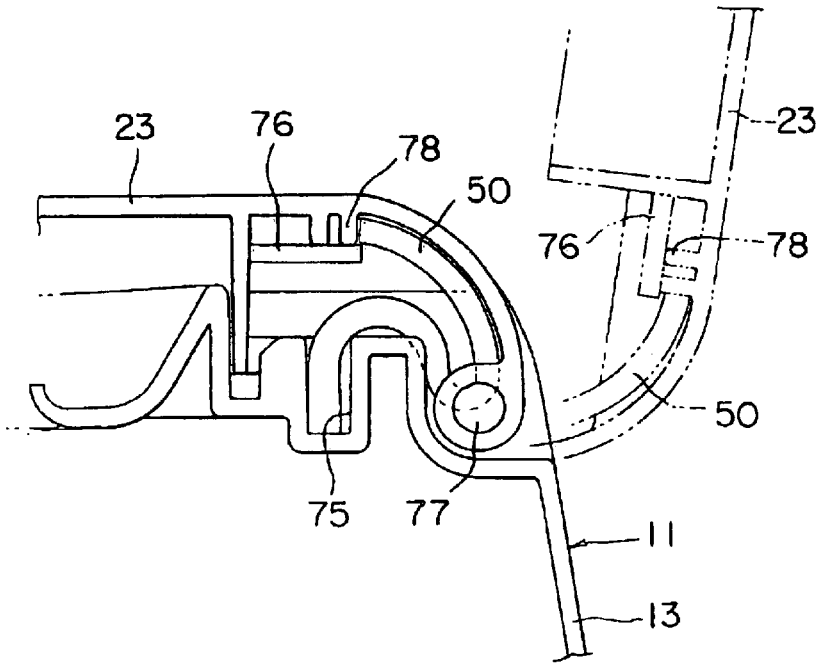
FIG. 5 is an enlarge sectional view of a hinge part connecting the hinged lid to the container body in the container with a hinged lid shown in FIG. 1.
Figure 8:
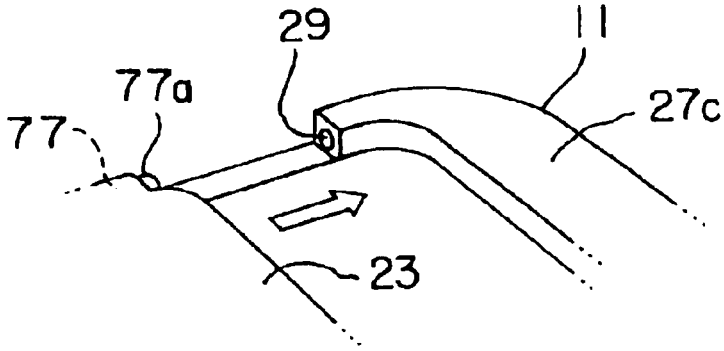
FIG. 8 is a perspective view of a pivot shaft on which the hinged lid turns, and a support hole formed in the container body in the container with a hinged lid shown in FIG. 1.

As shown in FIG. 5, a pivot shaft 77 is formed integrally with the hinged lid 23. The pivot shaft 77 is supported on the side wall 13 of the container body 11. Projecting end parts 77*a* of the pivot shaft 77 are fitted in holes 29 formed in the container body 11, and the hinged lid 23 swings on the pivot shaft 77 relative to the container body 11 (FIG. 8). As shown in FIG. 8, the holes 29 are bottomed and do not extend through the container body 11. Therefore, moisture contained in the container body 11 is unable to leak outside through the holes 29.

The upper wall 27 of the container body 11 has a first upper part (first thin upper wall) 27*a* forming a substantially central part of the upper wall 27, a second upper part (second thin upper wall) 27*b* formed on a level above that of the first upper part 27*a* so as to surround the first upper part 27*a*, and a rising part 28 connecting the first upper part 27*a* and the second upper part 27*b*. The opening 24 through which the wet tissues 41 are taken out is formed in the first upper part 27*a*.

A sealing frame 37 is formed on the inner surface of the hinged lid 23 such that the sealing frame 37 is fitted in a space between an outer rib 51 and an inner rib 52 formed on the first upper part 27*a*. When the hinged lid 23 is turned on the pivot shaft 77 so that the sealing frame 37 is fitted in the space between the outer rib 51 and the inner rib 52, the opening 24 is covered hermetically with the hinged lid 23.

Figure 3:
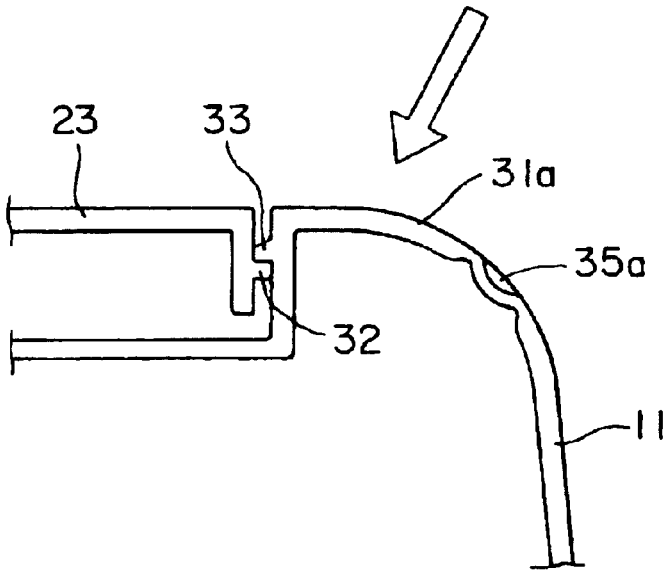
FIG. 3 is an enlarged sectional view of a locking projection formed in a hinged lid, and a catching projection formed in a container body in the container with a hinged lid shown in FIG. 1.

As shown in FIGS. 1 and 3, an end rib 36 is formed along a free edge of the hinged lid 23, and a locking means, or projection 32 is formed on the end rib 36.

The rising part 28 of the container body 11 is provided with a latching, or catching projection 33 for catching the locking projection 32 of the hinged lid 23. The container body 11 has an inclined wall 31 extending between the upper wall 27 and the side wall 13. A thin part 35 is formed on the inclined wall 31 so as to surround a region 31*a* of the inclined wall 31 corresponding to a part of the rising part 28 provided with the catching projection 33. The region 31*a* is bent down when depressed to release the locking projection 32 of the hinged lid 23 from the catching projection 33 of the rising part 28.

As shown in FIGS. 1 and 5, an elongate rubber plate 50 is interposed between the container body 11 and the hinged lid 23 to bias the hinged lid 23 in an opening direction. The container body 11 is provided with a recess 75 for receiving one end part of the rubber plate 50 therein, and the hinged lid 23 is provided with a rubber plate holding member 76 for fixedly holding the other end part of the rubber plate 50. The rubber plate 50 is positioned by inserting a projection 78 projecting from the hinged lid 23 in the rubber plate 50, and then the other end part of the rubber plate 50 is held firmly by the rubber plate holding member 76.

As shown in FIG. 1, the rubber plate 50 is placed at a position away from the respective middle parts of the container body 11 and the hinged lid 23 to the right, as viewed in FIG. 1.

Figure 17:
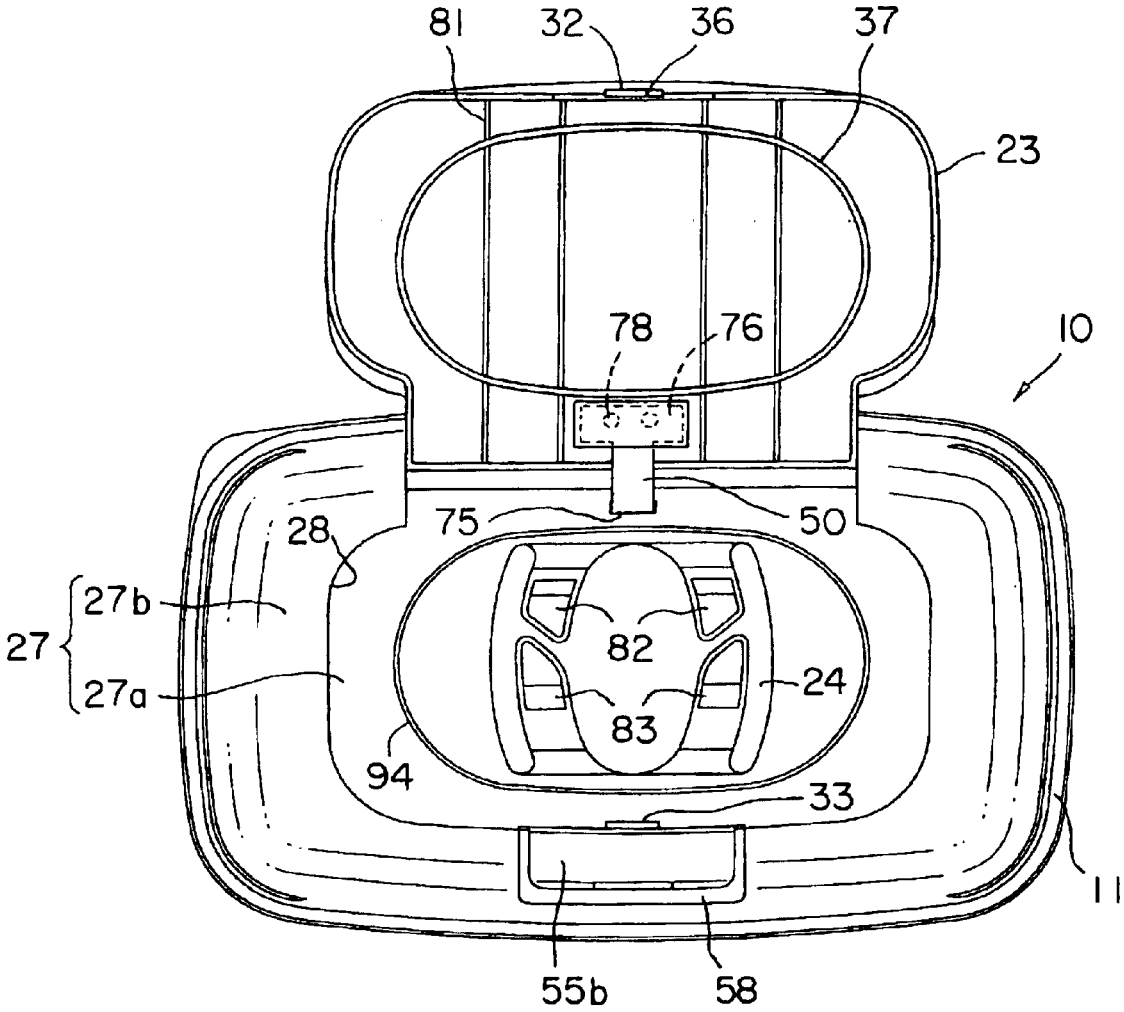
FIG. 17 is a plan view of a container with a hinged lid in a second embodiment according to the present invention.

The rubber plate 50 may be disposed at a position corresponding to the respective middle parts of the container body 11 and the hinged lid 23 as shown in FIG. 17.

Since the hinged lid 23 is supported on the side wall 13 of the container body 11, the hinged lid 23 can be formed in a large shape. When the hinged lid 23 is large and the rubber plate 50 is away from the middle part of the hinged lid 23 to the right, a large area can be secured around the opening 24 to thereby facilitate taking out the wet tissues 41 from the container.

When the hinged lid 23 is turned relative to the container body 11 for closing, the rubber plate 50 is curved along the inner surface of the hinged lid 23 as shown in FIG. 5 and biases the hinged lid 23 in the opening direction. The rubber plate 50 may be curved away from the hinged lid 23.

Figure 6:
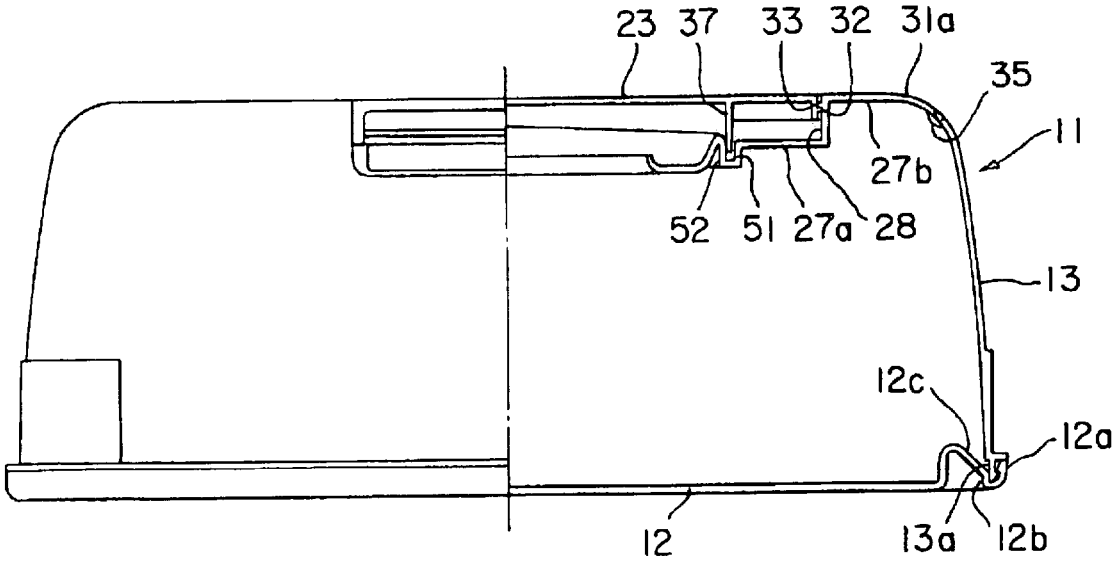
FIG. 6 is a sectional side view of the container with a hinged lid shown in FIG. 1.
Figure 7:
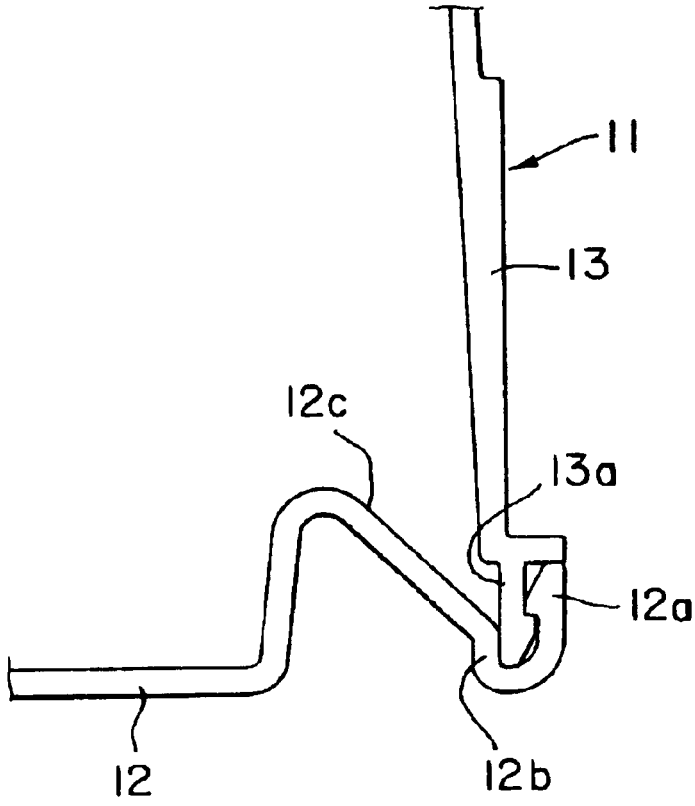
FIG. 7 is a sectional view of the joint of the container body and the bottom wall in the container with a hinged lid shown in FIG. 1.

A joining structure joining together the container body 11 and the bottom wall 12 will be described with reference to FIGS. 6 and 7. As shown in FIGS. 6 and 7, a joining rib 13*a* is formed along the lower edge of the side wall 13 of the container body 11, and a pair of catching ribs 12*a* and 12*b* are formed along the periphery of the bottom wall 12. The joining rib 13*a* is forced into a groove formed between the pair of latching, or latching or catching ribs 12*a* and 12*b* to join together the container body 11 and the bottom wall 12.

Referring to FIGS. 6 and 7, a guide rib 12*c* extends inward from the latching or catching rib 12*b* of the bottom wall 12. The guide rib 12*c* has an inclined part merging into the catching rib 12*b* to guide the joining rib 13*a* of the side wall 13 into the groove formed between the pair or catching ribs 12*a* and 12*b*.

The container body 11 and the hinged lid 23 are made of a polypropylene resin (PP) by injection molding. Materials suitable for forming the container body 11 and the hinged lid 23 other than the polypropylene resin are PE resins, PS resins, ABS resins, elastomers, PET resins, PVC resins and polycarbonate resins. A linear low-density polyethylene (LLDPE) is a preferable material for forming the bottom wall 12. The rubber plate 50 is made of silicone rubber. The rubber plate holding member 76 is made of a PP resin.

Figure 4:
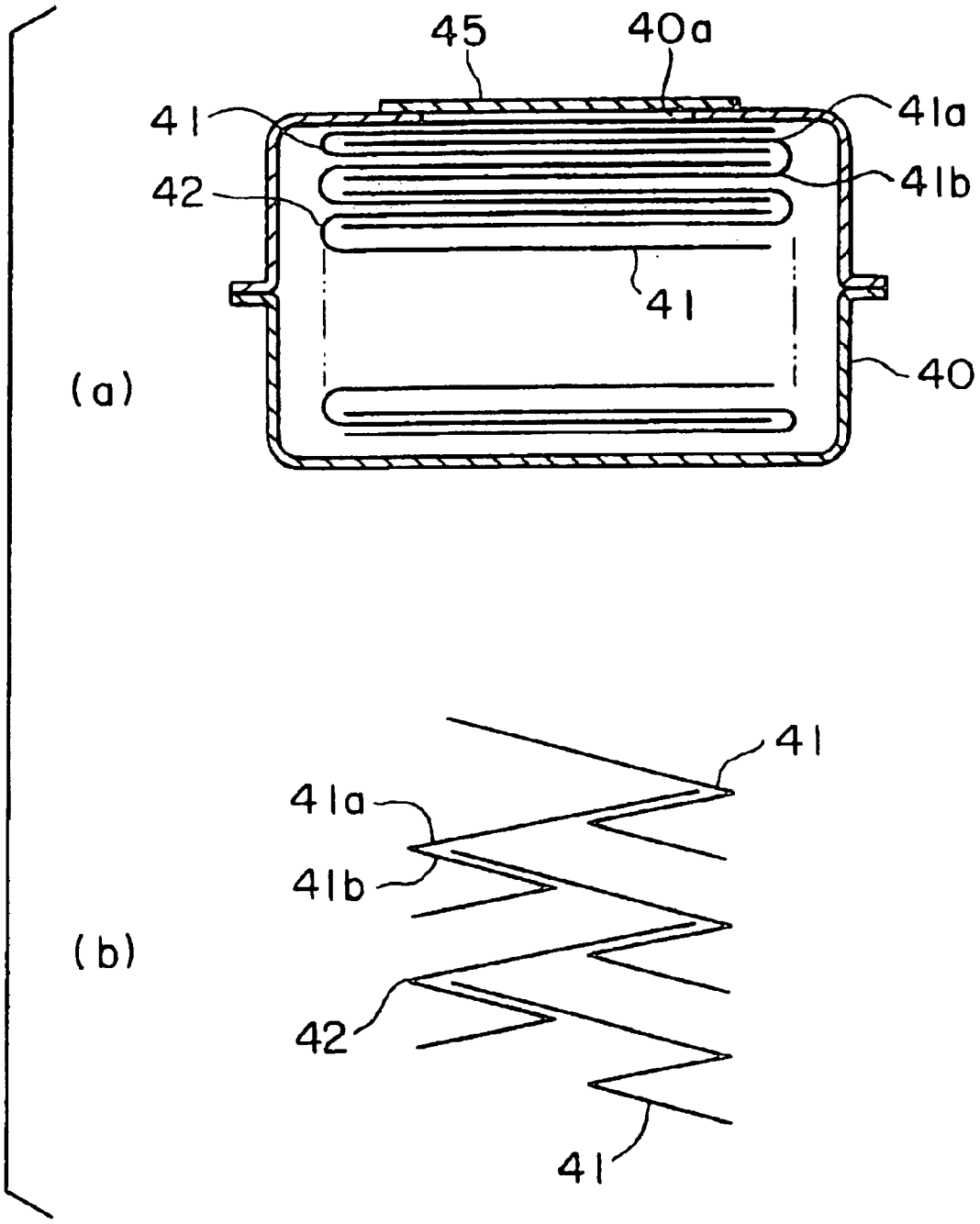
FIG. 4 is an enlarged sectional view of a sealed pouch containing wet tissues.

The wet tissues 41 contained in the container body 11 will be explained with reference to FIG. 4. As shown in FIG. 4(*a*), the folded wet tissues 41 are stacked and sealed in a sealed pouch 40 of a flexible sheet. Each wet tissue 41 is folded substantially double along a fold 42. The folds 42 in the wet tissues 41 alternate so that the lower half 41*b* of a first wet tissue 41 is sandwiched between the upper half 41*a* of a second wet tissue 41 underlying the first wet tissue 41 and the upper half 41*a* of a third wet tissue 41 underlying the second wet tissue 41. Thus, when the top wet tissue 41 is taken with fingers and pulled out, the lower half 41*b* of the top wet tissue 41 entrains the upper half 41*a* of the second top wet tissue 41. There is not particular restrictions on the manner of folding the wet tissues 41 provided that the wet tissues 41 can be stacked so that the same can successively taken out. For example, the wet tissues 41 may be folded as shown in FIG. 4(*b*). An opening 40*a* is formed in the upper wall of the sealed pouch 40, and the opening 40*a* is closed hermetically with a covering sheet 45 detachably attached to the upper wall of the sealed pouch 40.

The wet tissues 41 are made from a textile material, such as a nonwoven fabric, a paper sheet or a gauze fabric, a foam sheet or a paper-base soft material. The wet tissues 41 may be impregnated with a liquid, such as a wetting material containing a sterilant, a disinfectant or a detergent, a lotion or an emulsion.

Functions of this embodiment will be described below.

One end part of the rubber plate 50 is inserted in the recess 75 of the container body 11, and the other end part of the same is positioned by the projection 78 on the hinged lid 23 and is held by the rubber plate holding member 76 on the hinged lid 23.

The sealed pouch 40 hermetically containing the wet tissues 41 is put in the container body 11 through the open lower end of the container body 11. Then, the joining rib 13*a* of the container body 11 is forced into the groove between the pair of catching ribs 12*a* and 12*b* of the bottom wall 12 to close the open lower end of the container body tightly with the bottom wall 12. The container body 11 and the bottom wall 12 can easily be joined together because the joining rib 13*a* of the container body 11 is guided toward the groove between the pair of catching ribs 12*a* and 12*b* by the inclined part of the guide rib 12*c* of the bottom wall 12.

Then, hinged lid 23 is moved in a closing direction relative to the container body 11, the locking projection 32 of the hinged lid 23 is caught by the catching projection 33 of the container body 11 to cover the opening 24 of the container body 11 tightly with the hinged lid 23. The sealing frame 37 of the hinged lid 23 is forced into the groove between the outer rib 51 and the inner rib 52 of the container body 11 to seal a space surrounded by the sealing frame 37 hermetically.

Since the rubber plate 50 is held fixedly by the rubber plate holding member 76 formed at a position at a predetermined distance from the container body 11 as shown in FIG. 1, the rubber plate 50 exerts a force on the rubber plate holding member 76 at a short distance inside from the pivot shaft 77 to turn the swing lid 23 in the opening direction. Generally, the container 10 containing the wet tissues is used in an environment of relatively high temperatures, such as in a room in summer. Therefore, the container body 11 and the hinged lid 23 are liable to be softened, According to the present invention, the turning end of the swing lid 23 is less deformed when the point of action of the force of the rubber plate 50 on the hinged lid 23 is at a short distance inside from the pivot shaft 77 than when the point of action of the force of the rubber plate 50 is near the pivot shaft 77 on the turning end of the swing lid 23.

When using the wet tissues 41, the region 31*a* of the inclined wall 31 is depressed, only the region 31*a* can be turned and bent about a horizontal part 35*a* of the thin part 35 without bending the upper wall 27 of the container body 11 so that the locking projection 32 is released from the catching projection 33. Consequently, the swing lid 23 is turned on the pivot shaft 77 in the opening direction by the resilience of the rubber plate 50 and the hinged lid 23 is opened.

Then, the top wet tissue 41 is taken between fingers and is pulled upward to take out the top wet tissue 41 through the opening 24. The top wet tissue 41 is pulled further to take out the same from the container body 11. The lower half 41*b* of the top wet tissue 41 entrains the upper half 41*a* of the second top wet tissue 41. As the top wet tissue 41 is pulled further, the upper half 41*a* of the second top wet tissue 41 is caught by the rim 24*a* of the outlet opening 24 and is separated from the lower half 41*b* of the top wet tissue 41.

In this embodiment, the region 31*a* of the inclined wall 31 is turned and bent about the horizontal part 35*a* of the thin part 35 when the same is depressed; consequently, the locking projection 32 of the hinged lid 23 can directly and surely be released from the catching projection 33 formed in the rising part 28 forming the inner wall of the region 31*a*.

Since the hinged lid 23 is supported for swinging on the side wall 13 of the container body 11, the hinged lid 23 can be formed in a large shape. Since the rubber plate 50 is extended between the container body 11 and the swing lid 23 and is placed at the position away from the respective middle parts of the container body 11 and the hinged lid 23 to the right, and the hinged lid 23 can be formed in a large shape, a large area can be secured around the opening 24.

A container with a hinged lid in a modification of the container with a hinged lid in the first embodiment will be described with reference to FIGS. 9 and 10. In the container with a hinged lid shown in FIGS. 9 and 10, a container body 11 has an upper wall 27 having a recessed portion, or depressed part 58 formed near a free end edge of a hinged lid 23 and an upper end part of a side wall 13. A vertical wall 55*a* rises from the inner end of the depressed part 59, and a horizontal strip 55*b* projects from an upper end part of the vertical wall 55*a* and extends horizontally. A catching projection 33 for catching a locking projection 32 formed on the hinged lid 23 projects from the inner surface of the upper end part of the vertical wall 55*a*. The vertical wall 55*a* and the horizontal strip 55*b* compose a lid operating device 55 for opening the hinged lid 23.

Figure 9:
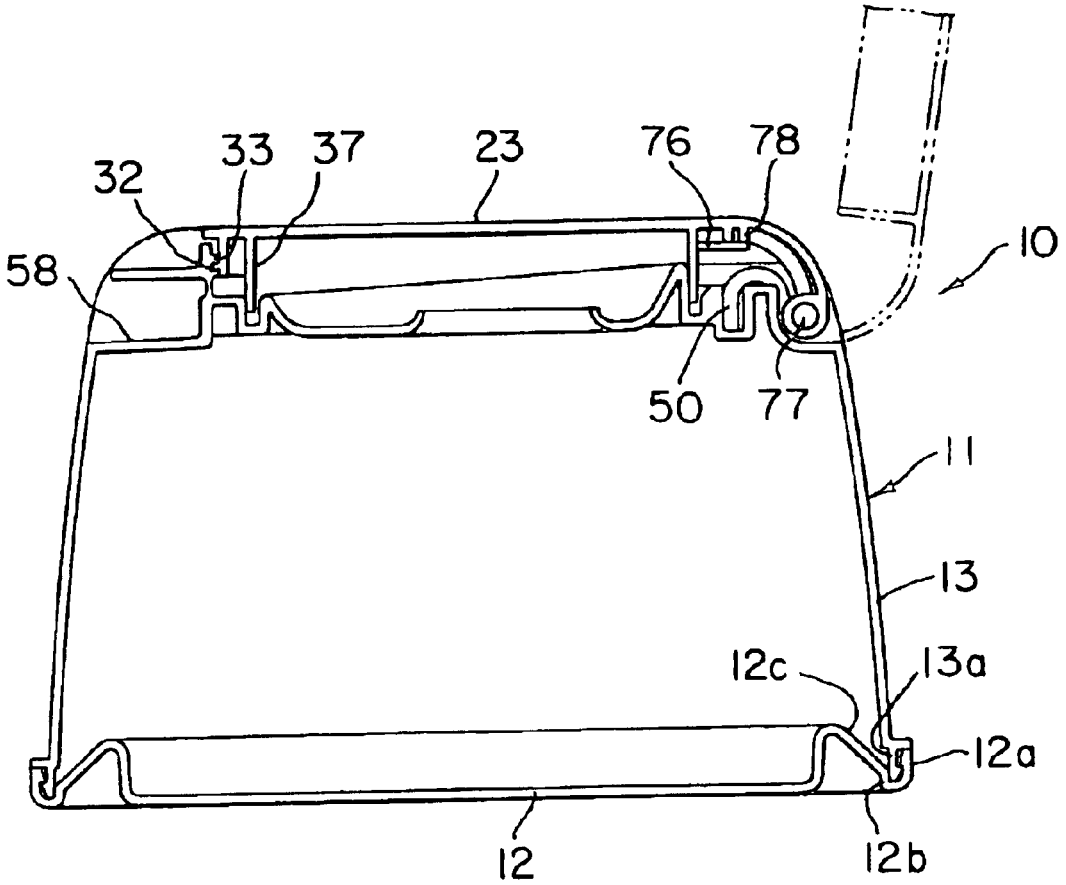
FIG. 9 is a sectional side view of a container with a hinged lid in a modification of the container with a hinged lid in the first embodiment shown in FIG. 1.
Figure 10:
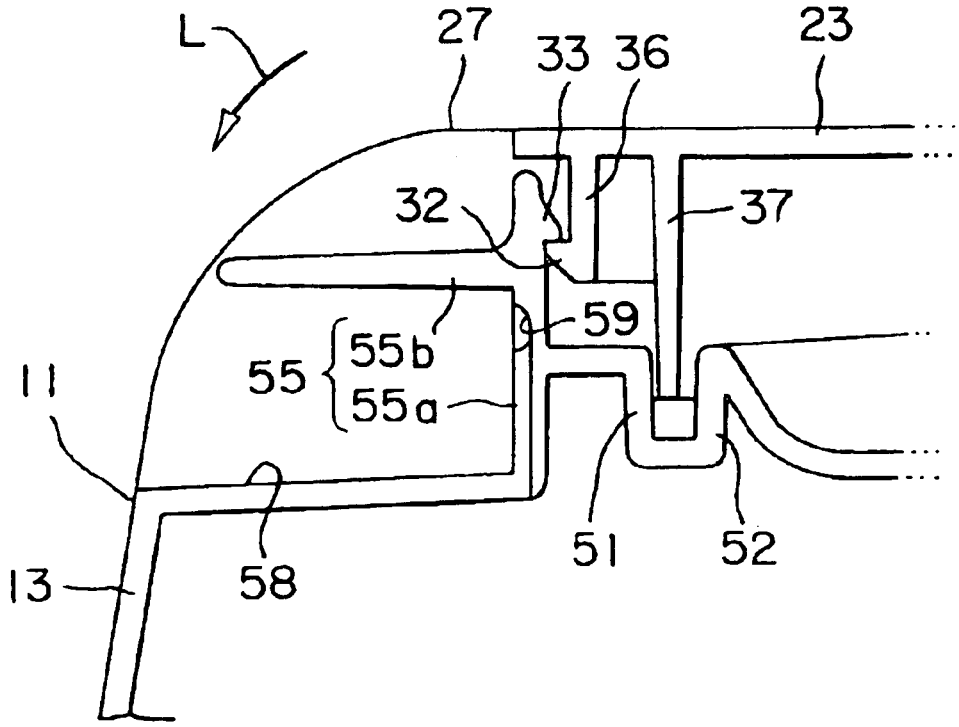
FIG. 10 is an enlarged view of the container with a hinged lid shown in FIG. 9.

In other respects, the container with a hinged lid shown in FIGS. 9 and 10 is substantially the same as the container with a hinged lid in the first embodiment shown in FIGS. 1 to 8. Therefore, parts shown in FIGS. 9 and 10 like or corresponding to those of the first embodiment shown in FIGS. 1 to 8 are designated by the same reference characters and the description thereof will be omitted.

Referring to FIGS. 9 and 10, the horizontal strip 55*b* of the operating device 55 is depressed to bend a thin part of the vertical wall 55*a* so that the vertical wall 55*a* is turned in the direction of the arrow L. Consequently, the locking projection 32 of the hinged lid 23 is released from the catching projection 33 of the vertical wall 55*a*.

Figure 11:
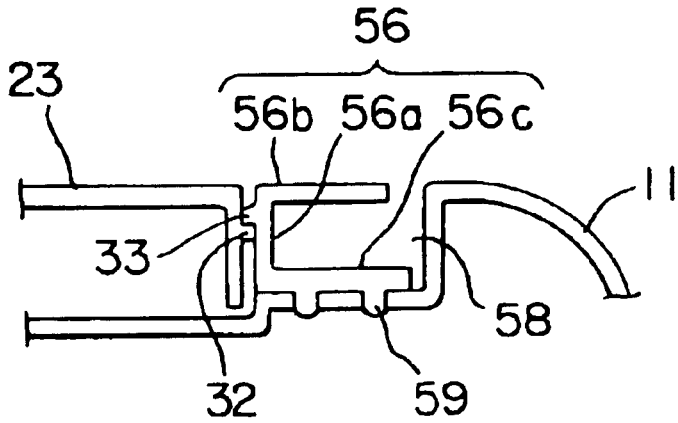
FIG. 11 is a sectional view of a container with a hinged lid in another modification of the container with a hinged lid in the first embodiment shown in FIG. 1.

The container with a hinged lid may be provided with an operating device 56 as shown in FIG. 11 instead of the operating device 55 shown in FIGS. 9 and 10. As shown in FIG. 11, the operating device 56 comprises a vertical plate 56*a*, a horizontal plate 56*b* extending from the upper edge of the vertical plate 56*a*, and a connecting plate 56*c* extending from the lower edge of the vertical plate 56*a* and provided with connecting ribs 59. The operating device 56 can detachably be attached to the container body 11 by forcing the connecting ribs 59 of the connecting plate 56*c* into slots formed in the depressed part 58 of the container body 11 as shown in FIG. 11.

Containers with a hinged lid in further modifications of the container with a hinged lid in the first embodiment will be described with reference to FIGS. 12 to 14. The containers with a hinged lid shown in FIGS. 12 to 14 differ from the container with a hinged lid shown in FIGS. 1 to 8 only in a sealing structure for hermetically joining together a sealing frame 37 formed in a hinged lid 23 and a container body 11, and is substantially the same in other respects as the container with a hinged lid shown in FIGS. 1 to 8.

Figure 12:
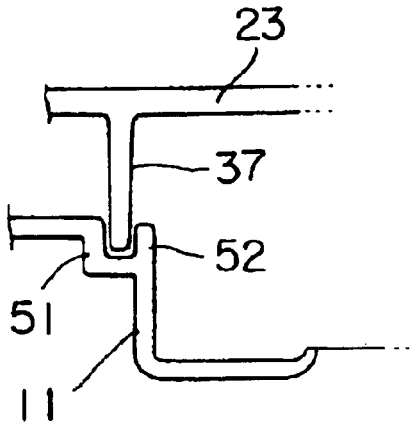
FIG. 12 is a sectional view of a container with a hinged lid in a further modification of the container with a hinged lid in the first embodiment shown in FIG. 1.
Figure 13:
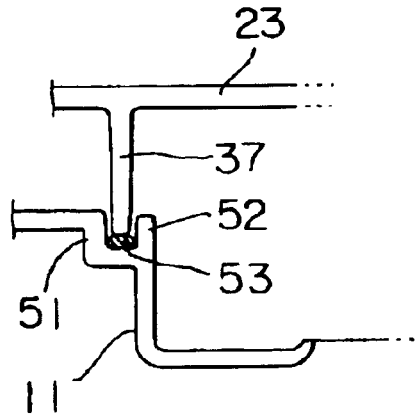
FIG. 13 is a sectional view of a container with a hinged lid in a further modification of the container with a hinged lid in the first embodiment shown in FIG. 1.
Figure 14:
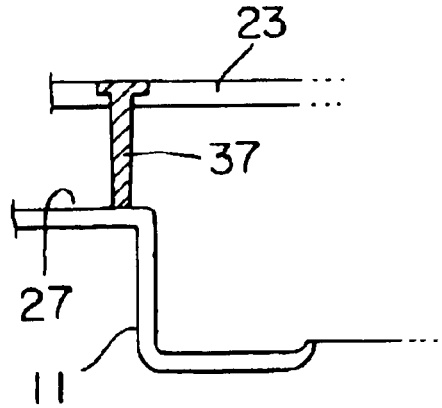
FIG. 14 is a sectional view of a container with a hinged lid in a further modification of the container with a hinged lid in the first embodiment shown in FIG. 1.

Therefore, parts shown in FIGS. 12 to 14 like or corresponding to those of the container with a hinged lid shown in FIGS. 1 to 8 are designated by the same reference characters and the description thereof will be omitted.

Referring to FIG. 12, the sealing frame 37 of the hinged lid 23 is forced into the groove between an outer rib 51 and an inner rib 52 and is held tight between the outer rib 51 and the inner rib 52.

Moisture contained in the container body 11 is unable to leak outside because a space surrounded by the sealing frame 37 is sealed hermetically as shown in FIG. 12.

A packing 53 may be placed in the groove between the outer rib 51 and the inner rib 52 of the container body 11 as shown in FIG. 13, and the packing 53 may be compressed between the edge of the sealing frame 37 of the hinged lid 23 and the bottom of the groove.

The sealing frame 37 of the hinged lid 23 may be made of an elastomer as shown in FIG. 14. The hinged lid 23 and the sealing frame 37 of an elastomer may integrally be formed by two-color injection molding. As shown in FIG. 14, the sealing frame 37 of an elastomer is in contact with the upper wall 27 of the container body 11.

A container with a hinged lid in a further modification of the container with a hinged lid in the first embodiment will be described with reference to FIG. 15.

Figure 15:
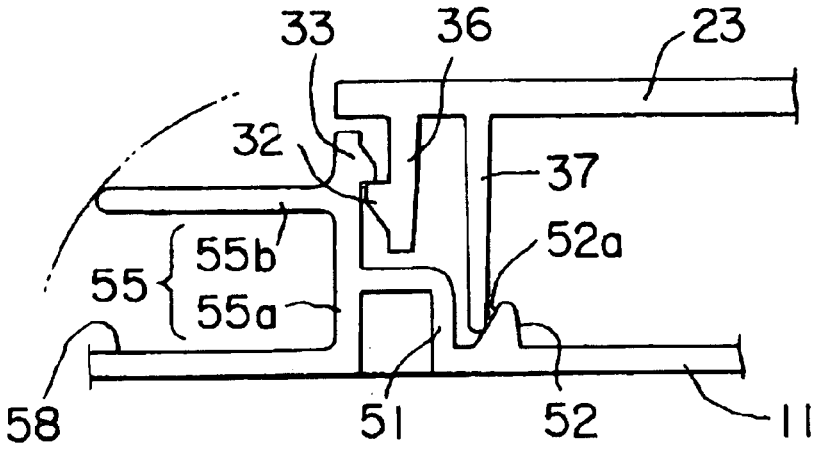
FIG. 15 is a sectional view of a container with a hinged lid in a further modification of the container with a hinged lid in the first embodiment shown in FIG. 1.

A container body 11 of the container 10 shown in FIG. 15 has a recessed portion, or depressed part 58 near a free end edge of a hinged lid 23, and an operating device 55 is constructed on the depressed part 58. The operating device 55 comprises a vertical wall 55*a* and a horizontal strip 55*b*. A latching part of catching projection 33 for catching a locking projection 32 formed in the hinged lid 23 is formed on the inner surface of the vertical wall 55*a* of the operating device 55.

an outer rib 51 and an inner rib 52 are formed on the container body 11. A surface 52*a* of the inner rib 52 facing the outer rib 51 is inclined, and a sealing frame 37 formed on the hinged lid 23 comes into contact with the inclined surface 52*a* of the inner rib 52.

The container with a hinged lid shown in FIG. 15 is substantially the same in other respects as the container with a hinged lid shown in FIGS. 1 to 8. Therefore, parts shown in FIG. 15 like or corresponding to those shown in FIGS. 1 to 8 are designated by the same reference characters and the description thereof will be omitted.

The inner rib 52 has the inclined surface 52*a* with which the sealing frame 37 comes into contact as shown in FIG. 15. Therefore, a fragment of the wet tissue 41 remaining between the outer rib 51 and the inner rib 52 can be forced to move outward by the action of the sealing frame 37 sliding along the inclined surface 52*a* and, consequently, the sealing frame 37 can be kept in close contact with the inclined surface 52*a* for hermetic sealing.

A container with a hinged lid in a further modification of the container with a hinged lid in the first embodiment will be described with reference to FIGS. 16(*a*) and 16(*b*). In the container with a hinged lid shown in FIGS. 16(*a*) and 16(*b*), one end part of a rubber plate 50 is extended in a horizontal position on an upper wall 27 of a container body 11 and is held fixedly in place by a rubber plate holding member 79 instead of inserting the same in a recess 75. Parts shown in FIGS. 16(*a*) and 16(*b*) like or corresponding to those shown in FIGS. 1 to 8 are designated by the same reference characters and the description thereof will be omitted.

Figure 16:
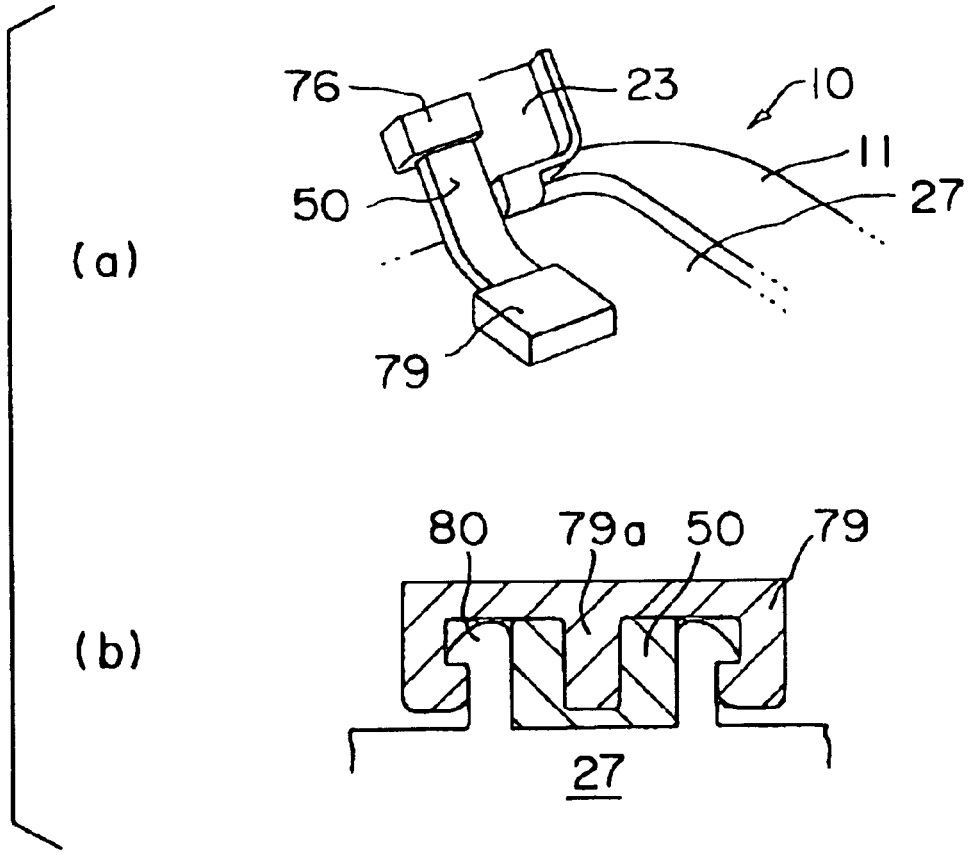
FIG. 16 is a view of a container with a hinged lid in a further modification of the container with a hinged lid in the first embodiment shown in FIG. 1.

As shown in FIGS. 16(*a*) and 16(*b*), one end part of the rubber plate 50 is extended in a horizontal position on the upper wall 27 of the container body 11 and is held fixedly in place by the rubber plate holding member 79 by engaging the rubber plate holding member 79 with projections 80 formed on the upper wall 27.

The rubber plate holding member 79 is provided on its inner surface with a projection 79*a*. The projection 79*a* is fitted in a recess formed in the rubber plate 50 to position the rubber plate 50 relative to the upper wall 27.

Second Embodiment

FIGS. 17 to 35 illustrate a container with a hinged lid in a second embodiment according to the present invention. In FIGS. 17 to 35, parts like or corresponding to those of the first embodiment shown in FIGS. 1 to 16 are designated by the same reference characters and the description will be omitted.

Figure 18:
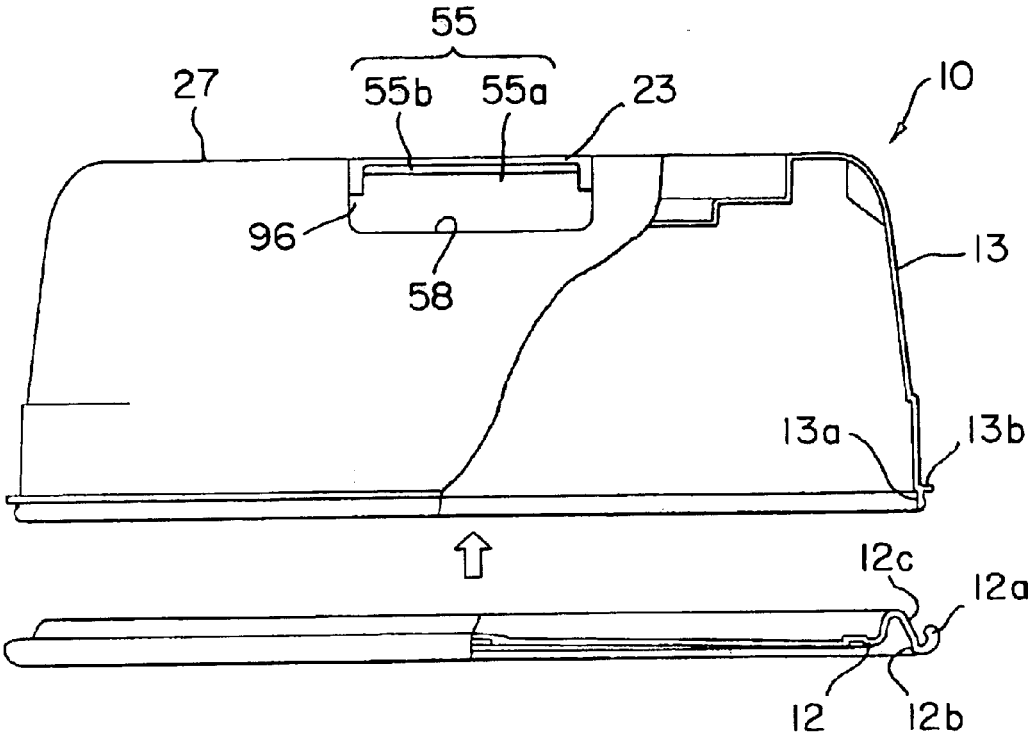
FIG. 18 is a side view of the container with a hinged lid shown in FIG. 17.
Figure 35:
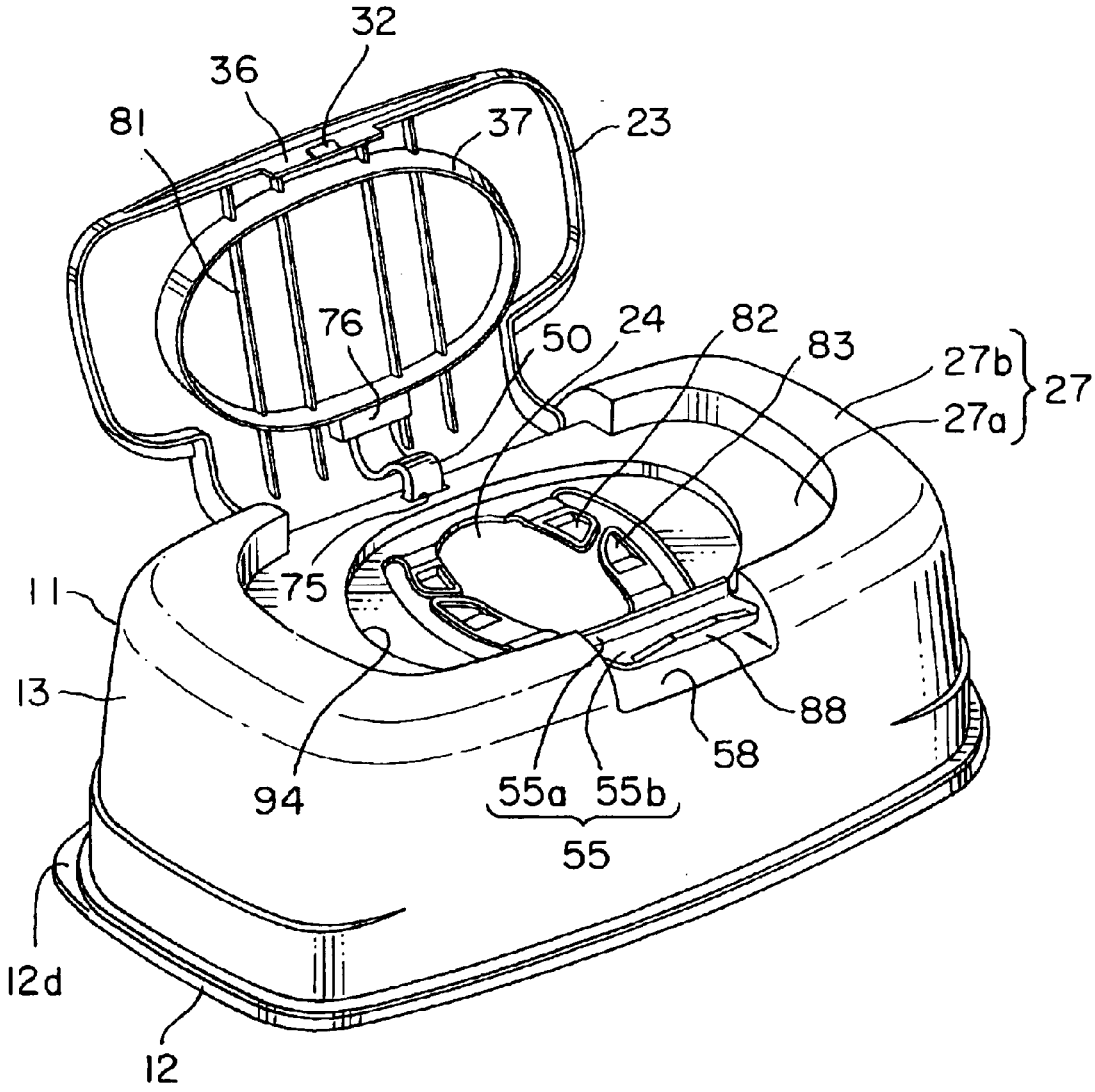
FIG. 35 is a perspective view of the container with a hinged lid shown in FIG. 17.

Referring to FIGS. 17, 18 and 35, a container 10 (container with a hinged lid) comprises a container body 11 containing wet tissues 41 (FIG. 4) and having an open lower end, and a bottom wall 12 covering the open lower end of the container body 11. The container body 11 has an upper wall 27 provided with an opening 24, and a side wall 13 extending down from the upper wall 27. A hinged lid 23 is swingably supported on the side wall 13 of the container body 11. The hinged lid 23 is capable of tightly covering the opening 24 of the upper wall 27.

Figure 24:
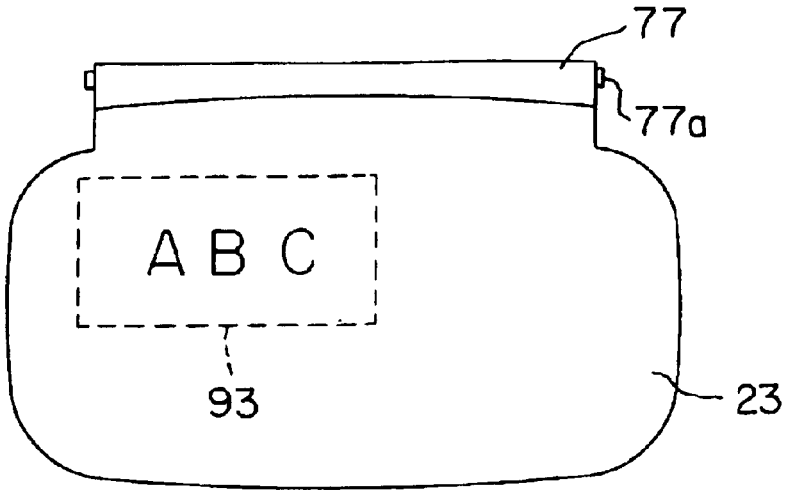
FIG. 24 is a plan view of a hinged lid included in the container with a hinged lid shown in FIG. 17.
Figure 25:
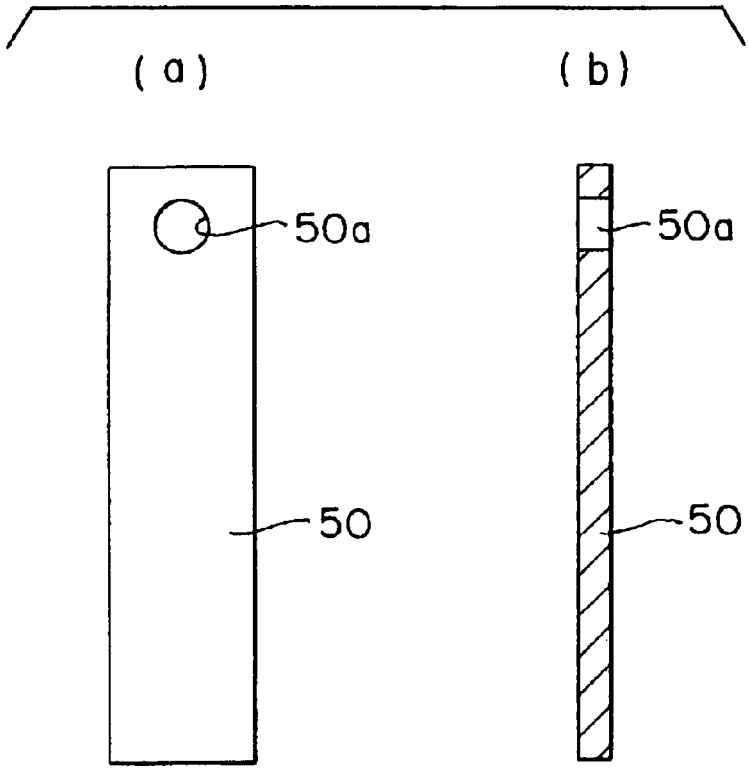
FIG. 25 is a view of a rubber plate included in the container with a hinged lid shown in FIG. 17.
Figure 26:
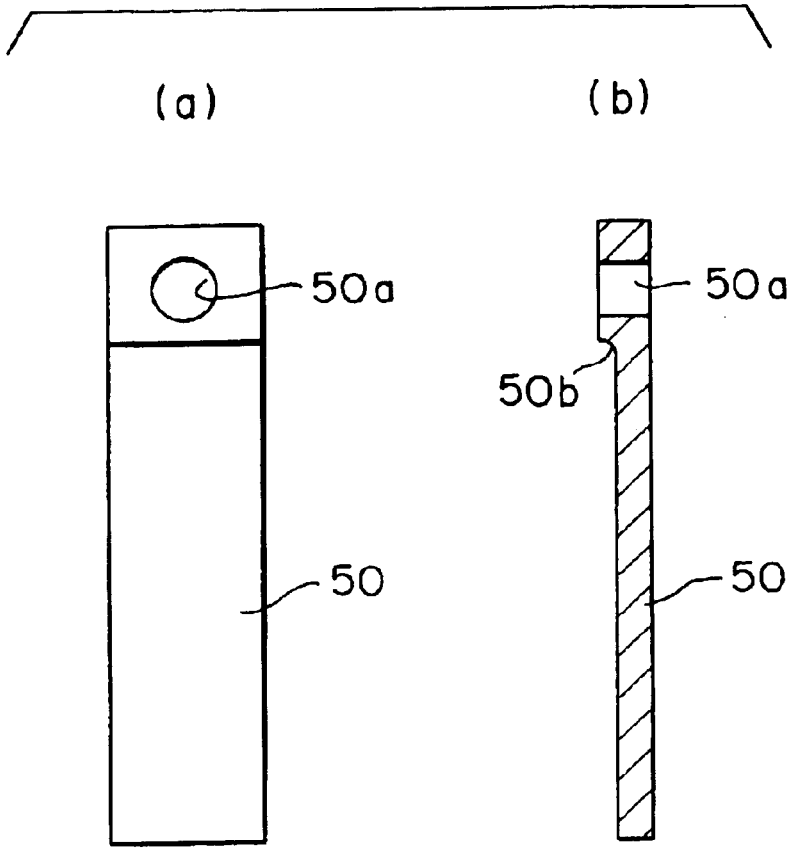
FIG. 26 is a view of a rubber plate.

As shown in FIG. 24, a pivot shaft 77 is formed integrally with the hinged lid 23. The pivot shaft 77 is supported on the side wall 13 of the container body 11. Projecting end parts 77*a* of the pivot shaft 77 are fitted in holes formed in the container body 11, and the hinged lid 23 swings on the pivot shaft 77 relative to the container body 11.

The upper wall 27 of the container body 11 has a first upper part (first thin upper wall) 27*a* forming a substantially central part of the upper wall 27, a second upper part (second thin upper wall) 27*b* formed on a level above that of the first upper part 27*a* so as to surround the first upper part 27*a*, and a rising part 28 connecting the first upper part 27*a* and the second upper part 27*b*. The opening 24 through which the wet tissues 41 are taken out is formed in the first upper part 27*a*.

A depression is formed in the first upper part 27*a* so as to define a space by a sealing wall 94, and a sealing frame 37 is formed on the inner surface of the hinged lid 23 such that the sealing frame 37 can be fitted in the space defined by the sealing wall 94. When the hinged lid 23 is turned on the pivot shaft 77 so that the sealing frame 37 is fitted in the space defined by the sealing wall 94, the opening 24 is covered hermetically with the hinged lid 23.

As shown in FIGS. 17 and 35, an end rib 36 is formed along a free edge of the hinged lid 23, and a locking projection 32 is formed on the end rib 36.

Figure 21:
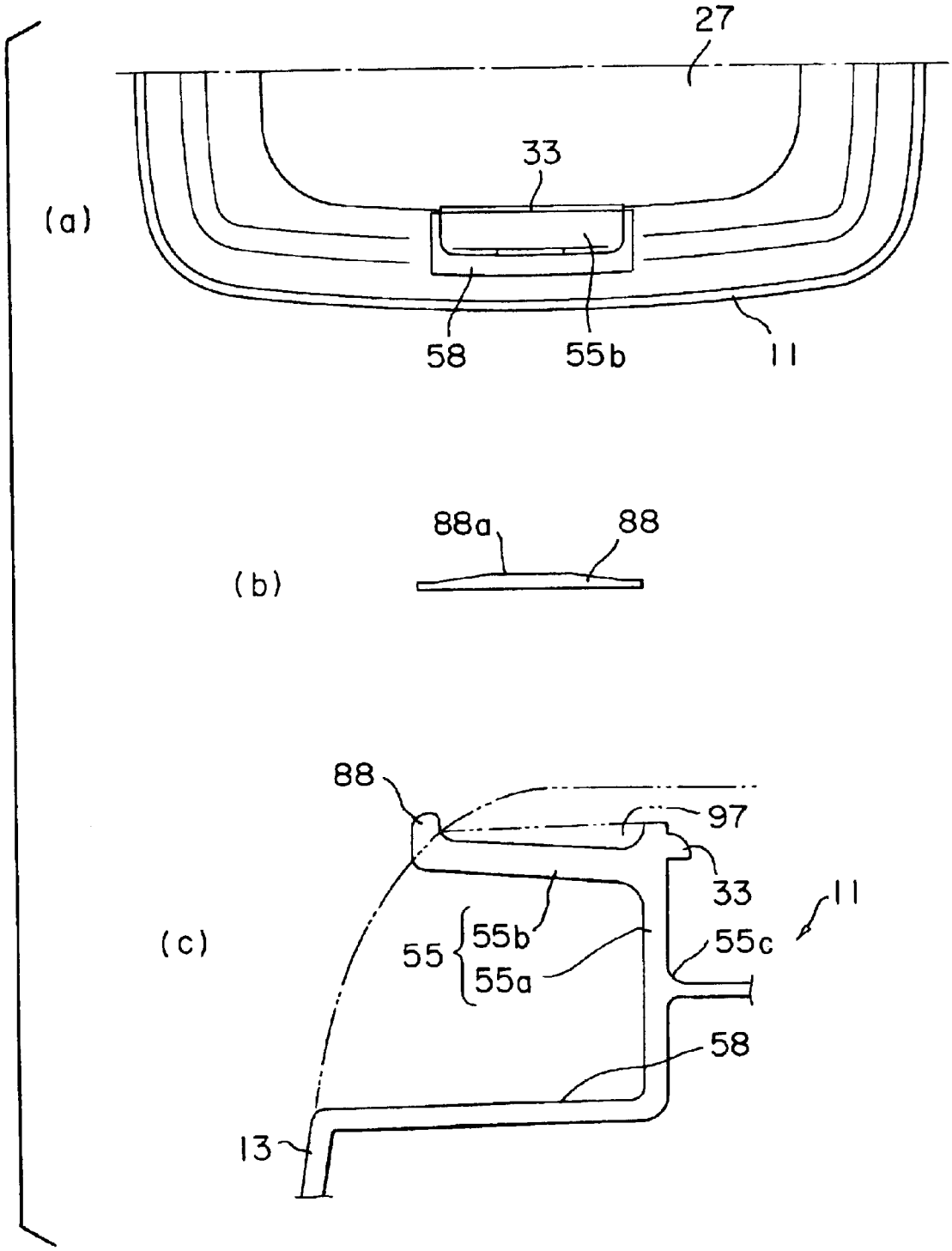
FIG. 21 is a view of an operating member included in the container body in the container with a hinged lid shown in FIG. 17.

As shown in FIG. 21, a depressed part 58 of the container body 11 is formed near the free end edge of the hinged lid 23 and the upper end of the side wall 13 in the upper wall 27, and a vertical wall 55*a* is extended from the depressed part 58. A horizontal strip 55*b* extends horizontally from an upper end part of the vertical wall 55*a*. A catching projection 33 for catching the locking projection 32 of the hinged lid 23 projects from the inner surface of the vertical wall 55*a*. The vertical wall 55*a* and the horizontal strip 55*b* form an operating device 55 for opening the hinged lid 23.

As shown in FIGS. 17 and 35, an elongate rubber plate 50 is interposed between the container body 11 and the hinged lid 23 to bias the hinged lid 23 in an opening direction. The container body 11 is provided with a recess 75 for receiving one end part of the rubber plate 50 therein, and the hinged lid 23 is provided with a rubber plate holding member 76 for fixedly holding the other end part of the rubber plate 50 at a predetermined distance from the container body 11. The rubber plate 50 is provided with positioning holes 50*a*, which will be described later, and projections 78 formed on the hinged lid 23 are fitted in the positioning holes 50*a* to position the rubber plate 50, and then the other end part of the rubber plate 50 is held firmly by the rubber plate holding member 76.

Figure 19:
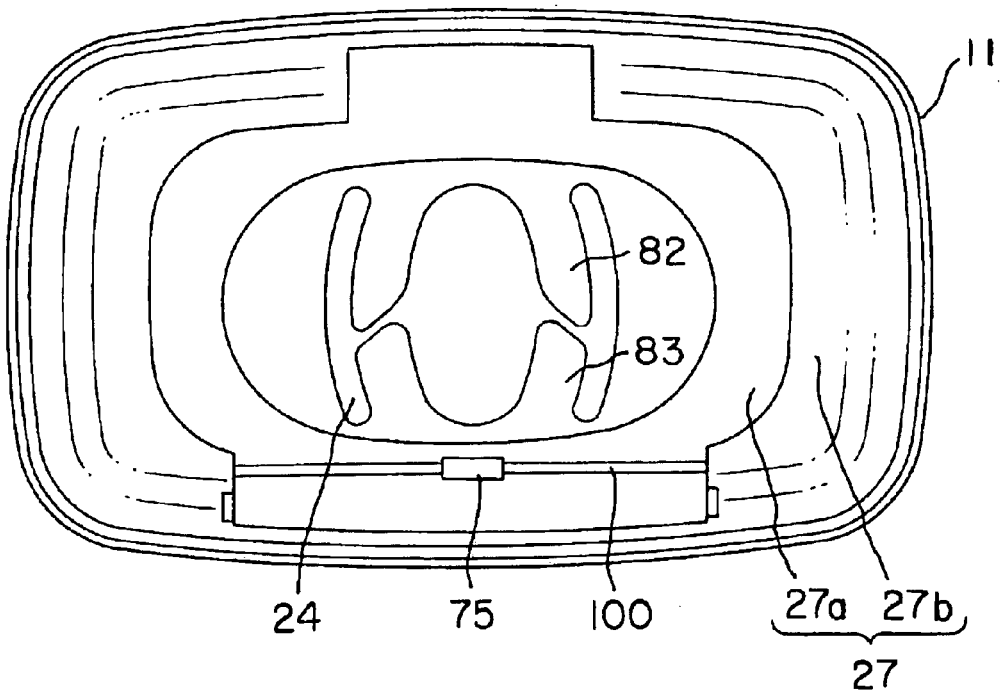
FIG. 19 is a plan view showing the inner surface of an upper wall of a container body included in the container with a hinged lid shown in FIG. 17.

As shown in FIG. 19, a strengthening rib 100 is formed on the inner surface of the upper wall 27 of the container body 11 so as to extend across the recess 75. The rib 100 prevents the upper wall 27 from being bent by force exerted on the upper wall 27 by the rubber plate 50 inserted in the recess 75. FIG. 19 shows the inner surface of the upper wall 27 of the container body 11.

As shown in FIG. 17, the rubber plate 50 is placed at a position corresponding to the respective middle parts of the container body 11 and the hinged lid 23.

Figure 23:
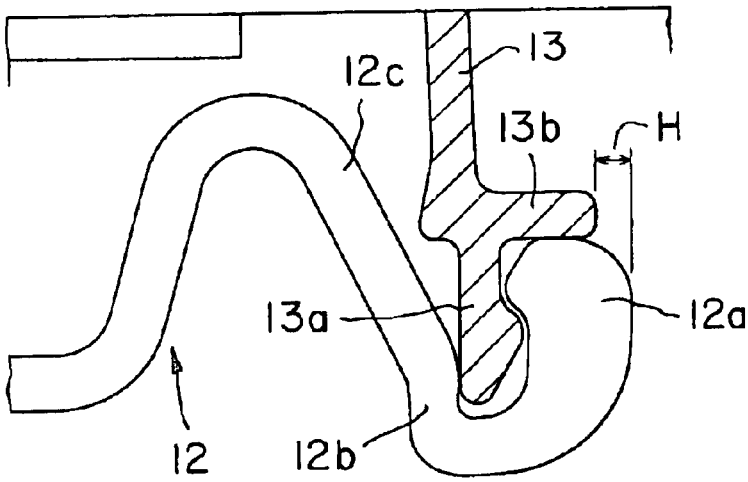
FIG. 23 is a view of a joining structure joining together a side wall of the container body, and the bottom wall in the container with a hinged lid shown in FIG. 17.

A joining structure joining together the container body 11 and the bottom wall 12 will be described with reference to FIG. 23. As shown in FIG. 23, a joining rib 13*a* is formed along the periphery of the periphery of the lower edge of the side wall 13 of the container body 11, and a pair of catching ribs 12*a* and 12*b* are formed along the periphery of the bottom wall 12. The joining rib 13*a* is forced into a groove formed between the pair of catching ribs 12*a* and 12*b* to join together the container body 11 and the bottom wall 12.

As shown in FIG. 23, an inclined rib 12*c* extends inward from the catching rib 12*b* of the bottom wall 12. The inclined rib 12*c* has an inclined part merging into the catching rib 12*b* to guide the joining rib 13*a* of the side wall 13 into the groove formed between the pair or catching ribs 12*a* and 12*b*. An external rib 13*b* projects from an upper part of the joining rib 13*a* of the side wall 13. The catching rib 12*a* of the bottom wall 12 comes into contact with the external rib 13*b*. The outer surface of the catching rib 12*a* of the bottom wall 12 lies at a distance H apart outward from the edge of the external rib 13*b* of the side wall 13. The catching rib 12*a* is formed along the entire periphery of the bottom wall 12. The bottom wall 12 can easily be separated from the side wall 13 by pressing the catching rib 12*a* with a finger away from the side wall 13.

The container body 11 and the hinged lid 23 are made of a polypropylene resin (PP) by injection molding. Materials suitable for forming the container body 11 and the hinged lid 23 other than the polypropylene resin are PE resins, PS resins, ABS resins, elastomers, PET resins, PVC resins and polycarbonate resins. A linear low-density polyethylene (LLDPE) is a preferable material for forming the bottom wall 12. The rubber plate 50 is made of silicone rubber. The rubber plate holding member 76 is made of a PP resin.

Further description of structures will be given. The hinged lid 23 is formed by the injection molding of a resin and is provided with a label 93 indicating letters "ABC" as shown in FIG. 24. The hinged lid 23 having the label 93 is formed by insert molding. When incorporating the label 93 into the hinged lid 23 by insert molding, the resin forming the hinged lid 23 shrinks, whereas the label 93 does not shrink. Therefore, it is possible that the hinged lid 23 warps after the same has been molded due to the difference in shrinkage between the resin forming the hinged lid 23 and the label 93. Thus, as shown in FIG. 17, reinforcing ribs 81 are formed on the inner surface of the hinged lid 23 to prevent the hinged lid 23 from warping after molding.

The operating device 55 formed in the container body 11 will be described below. Referring to FIG. 21(*a*)–(*c*), an edge part of the horizontal strip 55*b* of the operating device 55 is bent upward to form a finger rest 88. The horizontal strip 55*b* can easily be bent downward by depressing the finger rest 88 with a fingertip. The height of the finger rest 88 is increased from the opposite ends thereof toward a middle part thereof to facilitate applying a fingertip to the finger rest 88.

Although the operating device 55 is connected to the container body 11 by connecting a lower edge part 55*c* of the vertical wall 55*a* to the container body 11 as shown in FIG. 21(*a*)–(*c*), the operating device 55 may be connected by connecting a side connecting wall 96 horizontally extending from a lower part of the vertical wall 55*a* as shown in FIG. 18. When the side connecting wall 96 is connected to the container body 11, the repetitive deformation of only the lower edge part 55*c* of the vertical wall 55*a* can be avoided and, consequently, the whitening of the lower edge part 55*c* of the vertical wall 55*a* can be avoided and the reduction of the restoring force of the vertical wall 55*a* can be prevented.

The horizontal strip 55*b* extends from a part of the vertical wall 55*a* near the catching projection 33. When the finger rest 88 of the horizontal strip 55*b* is depressed, the operating device 55 comprising the vertical wall 55*a* and the horizontal strip 55*b* is turned on the lower edge part 55*c* of the vertical wall 55*a*. Since the horizontal strip 55*b* extends from the part of the vertical wall 55*a* near the catching projection 33, a part of the vertical wall 55*a* around the catching projection 33 is displaced greatly, whereby the locking projection 32 can easily be released from the catching projection 33.

The horizontal strip 55*b* may be provided on its upper surface with reinforcing ribs 97 connected to the vertical wall 55*a* as shown in FIG. 21(*c*). The reinforcing ribs 97 transmit a force applied to the horizontal strip 55*b* effectively to the vertical wall 55*a* to bend the vertical wall 55*a*.

Figure 34:
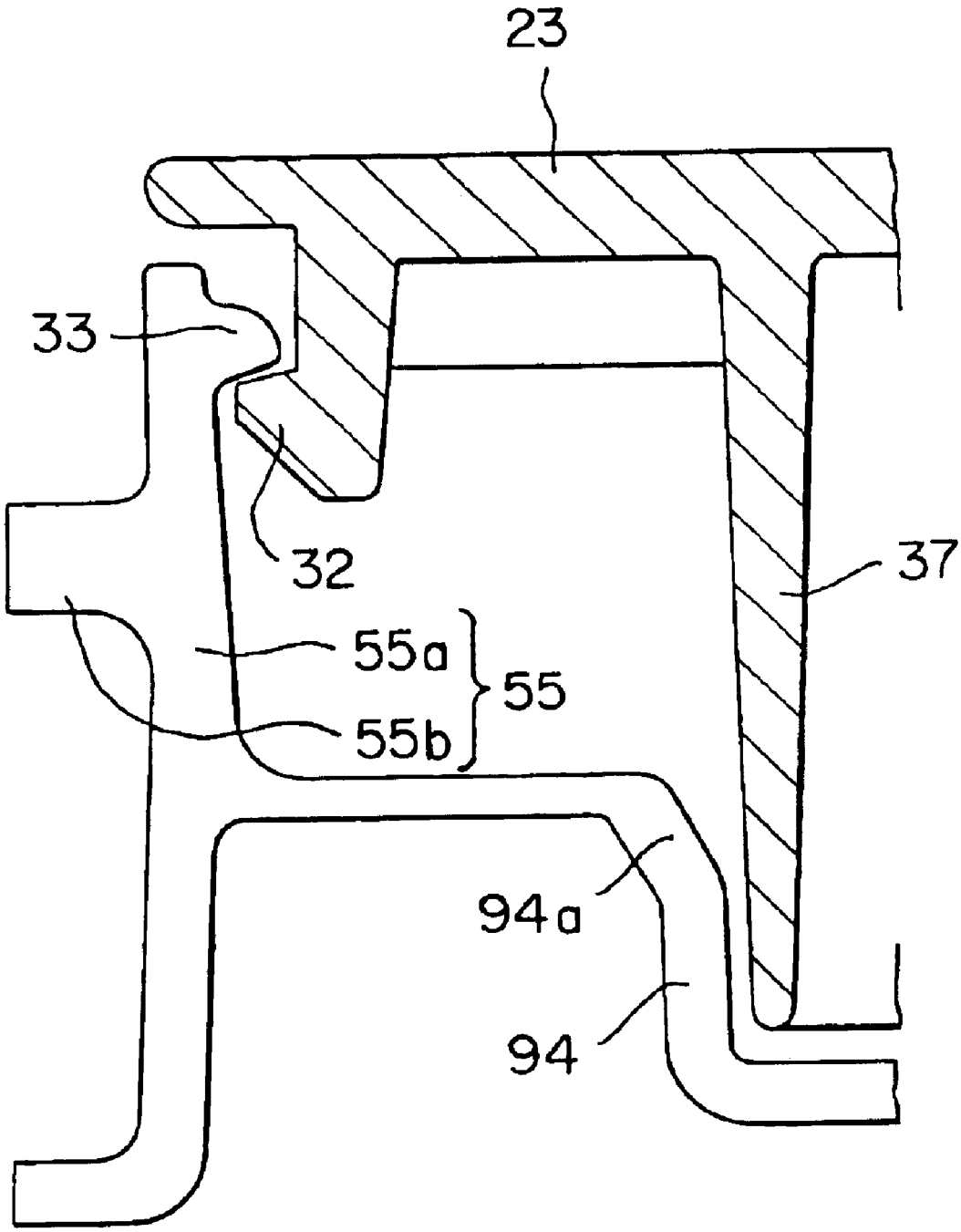
FIG. 34 is a view of a joining structure joining together a container body and a lid.

As shown in FIG. 17, the upper wall 27 of the container body 11 has the sealing wall 94 mating with the sealing frame 37 of the hinged lid 23. The edge of the sealing wall 94 is beveled to form a chamfer 94*a* so that the hinged lid 23 can easily be opened even if a wet tissue 41 is caught between the sealing frame 37 and the sealing wall 94. The chamfer 94*a* is formed in the entire edge of the sealing wall 94 excluding a section of the edge corresponding to the rubber plate 50. A high opening force of the rubber plate 50 acts on a part of the sealing frame 37 around the rubber plate 50 and hence it is not necessary to form the chamfer 94*a* in the section of the edge of the sealing wall 94 corresponding to the rubber plate 50 to ensure the hermetic engagement of the sealing frame 37 and the sealing wall 94 (FIGS. 34 and 35).

Figure 20:
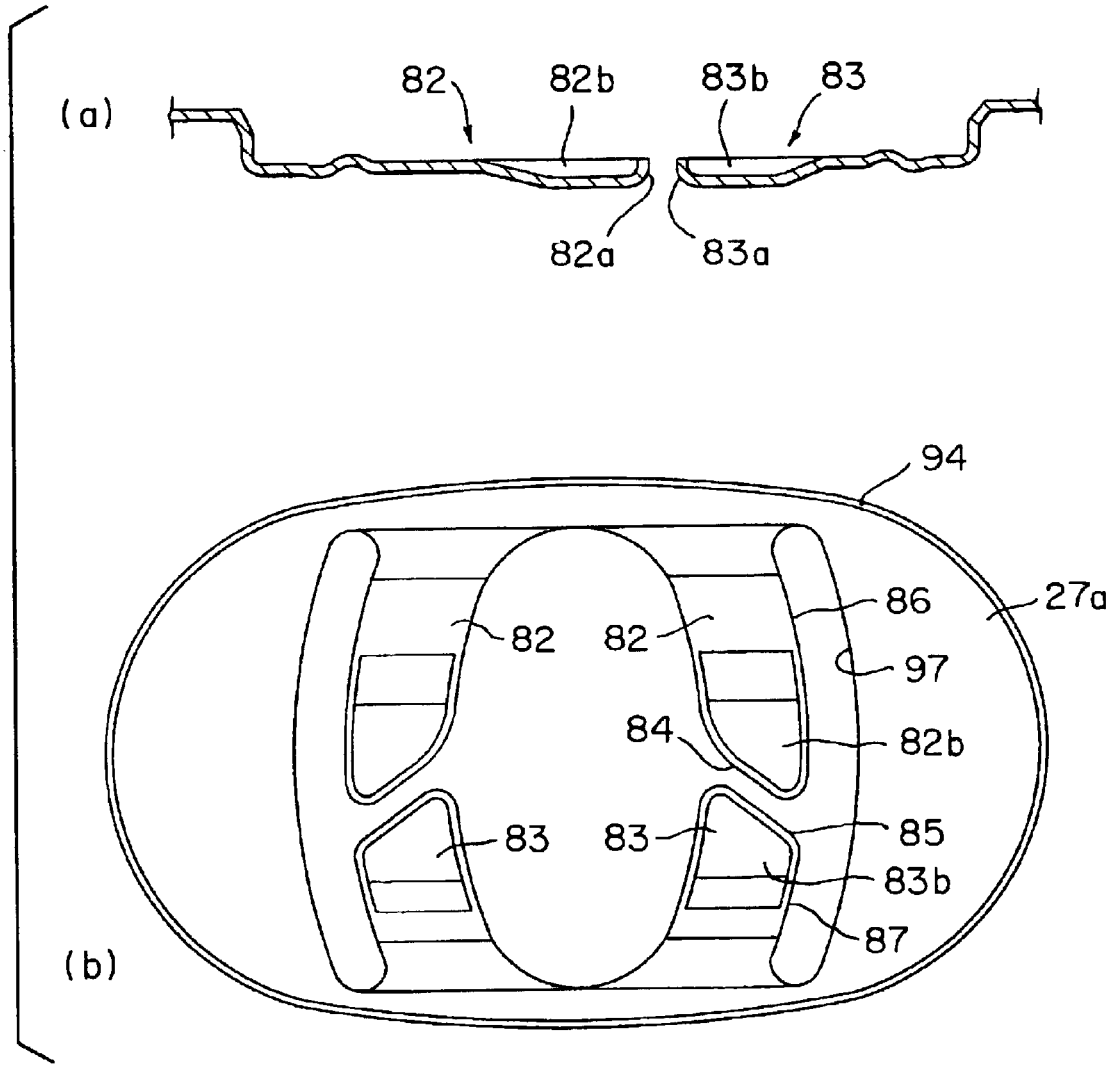
FIG. 20 is a view of a part of a container body provided with an opening in the container with a hinged lid shown in FIG. 17.

The configuration of the opening 24 formed in the upper wall 27 of the container body 11 will be described with reference to FIGS. 20(*a*)(*b*). Referring to FIG. 20(*a*)(*b*), the first upper part 27*a* of the upper wall 27 is provided with a pair of first flaps 82 extending toward the opening 24, and a pair of second flaps 83 formed opposite to the pair of first flaps 82, respectively. The pair of first flaps 82 and the pair of second flaps 83 have wavy sections, respectively, as shown in FIG. 20(*a*). The pair of first flaps 82 and the pair of second flaps 83 having the wavy sections are bendable in fixed directions perpendicular to their length and can surely and stably be bent.

As shown in FIG. 20(*a*), free end parts of the first flaps 82 and those of the second flaps 83 are bent in upwardly concave curves to form round end parts 82*a* and 83*a*, and concave parts 82*b* and 83*b* in the free end parts of the first flaps 82 and the second flaps 83, respectively. The tips of the round end parts 82*a* and 83*a* of the first flaps 82 and the second flaps 83 can be positioned on substantially the same level as the base ends of the first flaps 82 and the second flaps 83 by forming the concave parts 82*b* and 83*b*.

The pair of first flaps 82 are extended so as to diverge toward free end parts thereof so that a space between the first flaps 82 expands toward the free end parts of the first flaps 82, and the pair of second flaps 83 are extended so as to diverge toward free end parts thereof so that a space between the second flaps 83 expands toward the free end parts of the second flaps 83.

The end edge 84 of the respective first flap 82 and the end edge 85 of the second flap 83 opposite the first flap 82 are parallel to each other. A gap between the end edge 84 of the first flap 82 and the end edge 85 of the corresponding second flap 83 may be expanded toward the inside. Therefore, the wet tissue 41 lying in the opening 24 can smoothly be guided to the gaps between the end edges 84 of the first flaps 82 and the end edges 85 of the corresponding second flaps 83 to hold the wet tissue 41 surely between the end edges 84 and 85.

Outer edges 97 of the opening 24 facing the outer side edges 86 of the first flaps 82 and the outer side edges 87 of the second flaps 83 have a shape corresponding to that of the outer side edges 86 of the first flaps 82 and the outer side edges 87 of the second flaps 83.

Figure 27:
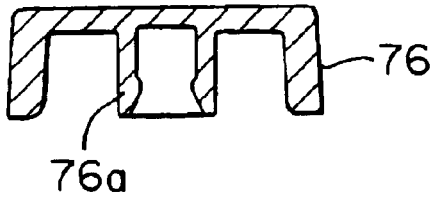
FIG. 27 is a sectional view of a holding part.

The shape of the rubber plate 50 will be described with reference to FIGS. 25 to 31. The rubber plate 50 may any one of those shown in FIGS. 25(*a*),(*b*), 26(*a*)(*b*). The rubber plate 50 shown in FIG. 25(*a*)(*b*) is provided with one positioning hole 50*a*, the rubber plate 50 shown in FIG. 26(*a*)(*b*) has a thick part 50*b* provided with one positioning hole 50*a*. A rubber plate holding member 76 having a boss 76*a* to be fitted in the positioning hole 50*a* shown in FIG. 27 is used in combination with the rubber plate 50 provided with the one positioning hole 50*a*.

Figure 28:
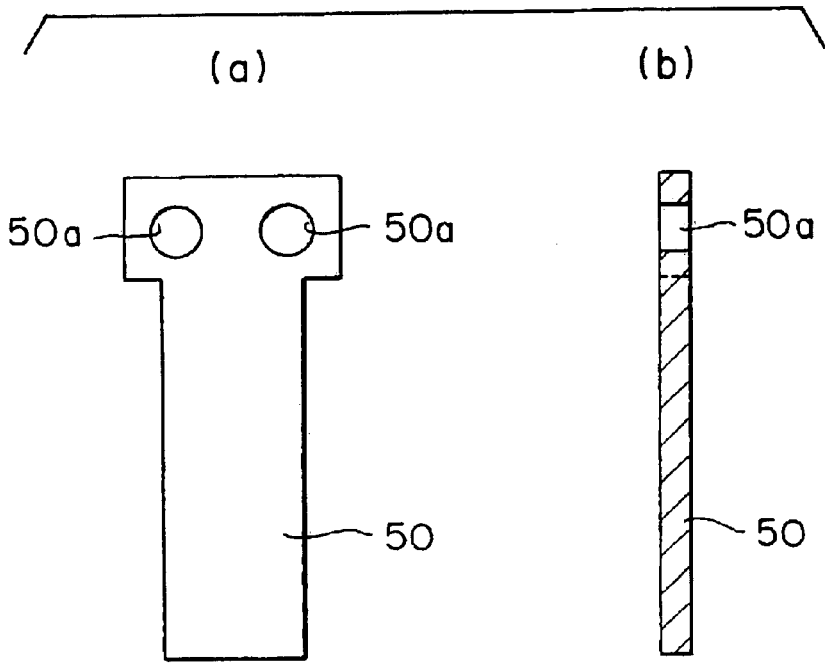
FIG. 28 is a view of a rubber plate.
Figure 29:
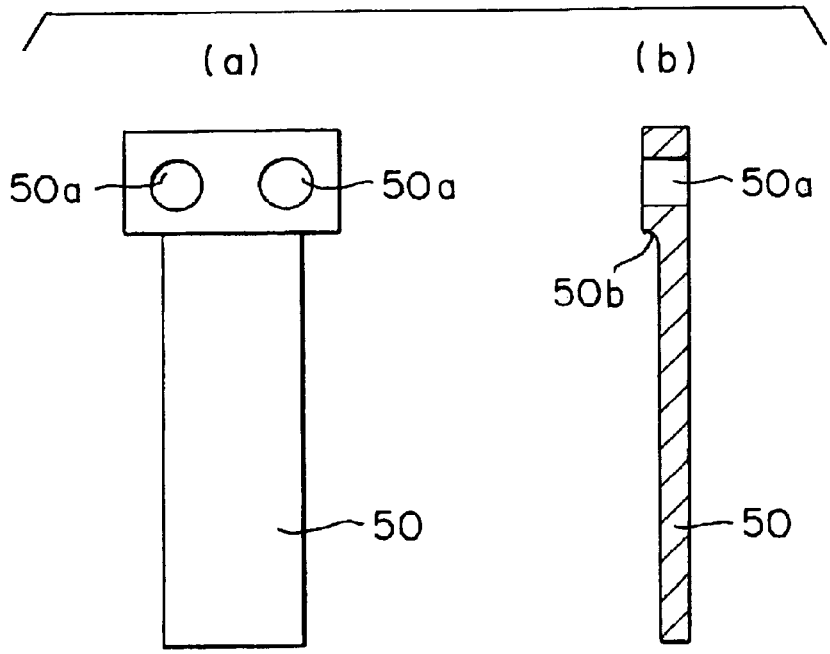
FIG. 29 is a view of a rubber plate.
Figure 30:
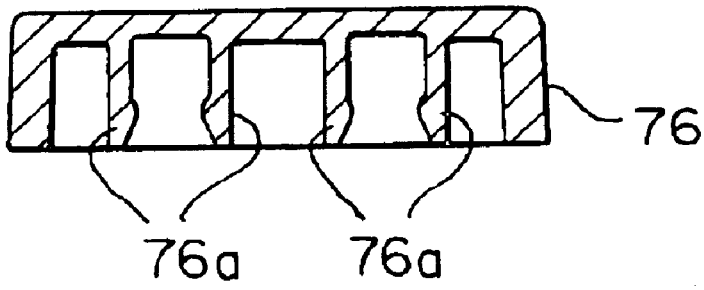
FIG. 30 is a sectional view of a holding part.

The container with a hinged lid may employ a rubber plate 50 provided with two positioning holes 50*a* as shown in FIGS. 28(*a*)(*b*) or a rubber plate 50 having a thick part 50*b* provided with two positioning holes 50*a* as shown in FIG. 29(*a*)(*b*). A rubber plate holding member 76 having two bosses 76*a* to be fitted in the positioning holes 50*a* as shown in FIG. 30 is used in combination with the rubber plate 50 provided with the two positioning holes 50*a*.

The rubber plate 50 provided with the two positioning holes 50*a* can accurately be positioned on the hinged lid 23.

Figure 31:
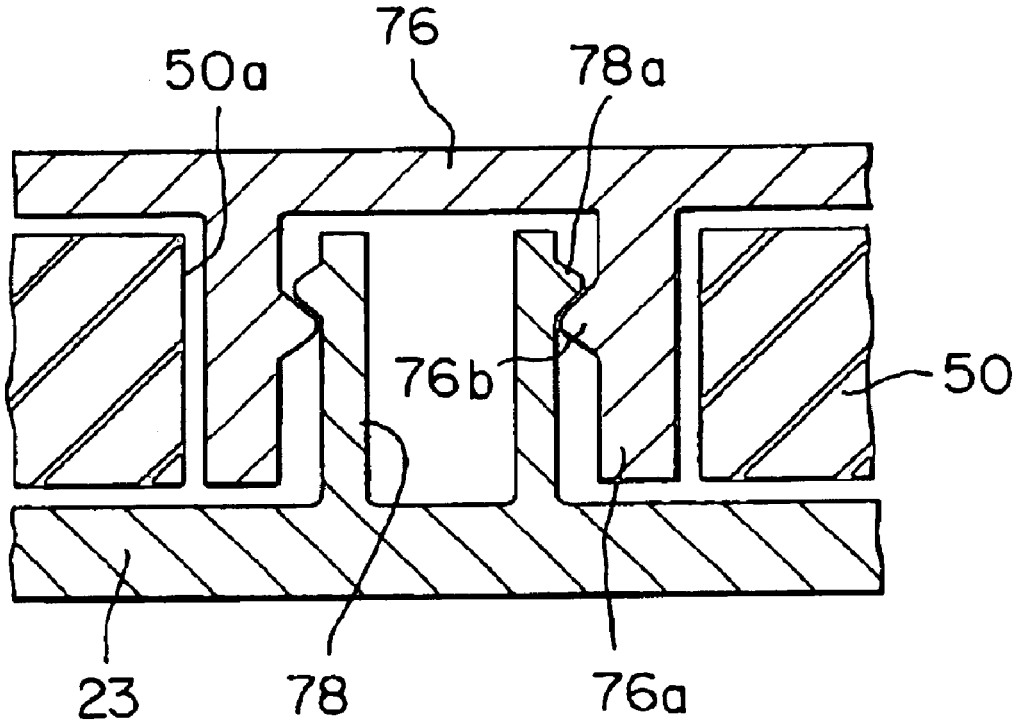
FIG. 31 is a view of a rubber plate held by a holding part.
Figure 32:
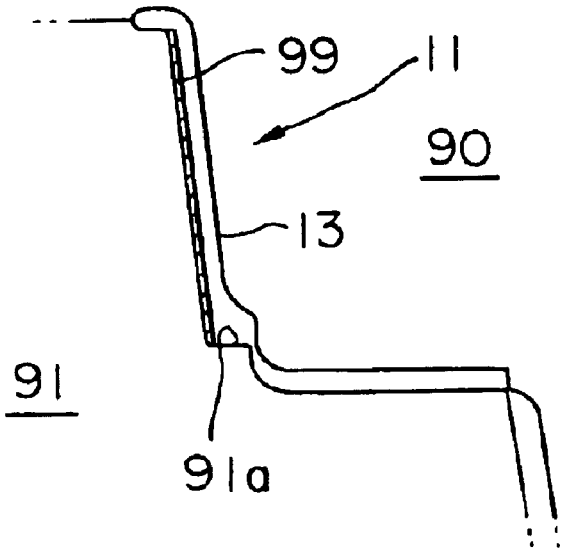
FIG. 32 is a view of a male mold and a female mold having a shoulder.

FIG. 31 shows the rubber plate 50 fastened to the hinged lid 23. Referring to FIG. 31, one end of the rubber plate 50 is placed on the hinged lid 23 with the projection 78 of the hinged lid 23 inserted in the positioning hole 50*a* of the rubber plate 50, and then the rubber plate holding member 76 having the boss 76*a* is pressed on the rubber plate 50 so that the boss 76*a* is inserted in a space between the projection 78 and the positioning hole 50*a* of the rubber plate 50 and the projections 76*b* of the boss 76*a* are engaged with the projections 78*a* of the projection 78 to fasten the end part of the rubber plate 50 firmly to the hinged lid 23.

Figure 22:
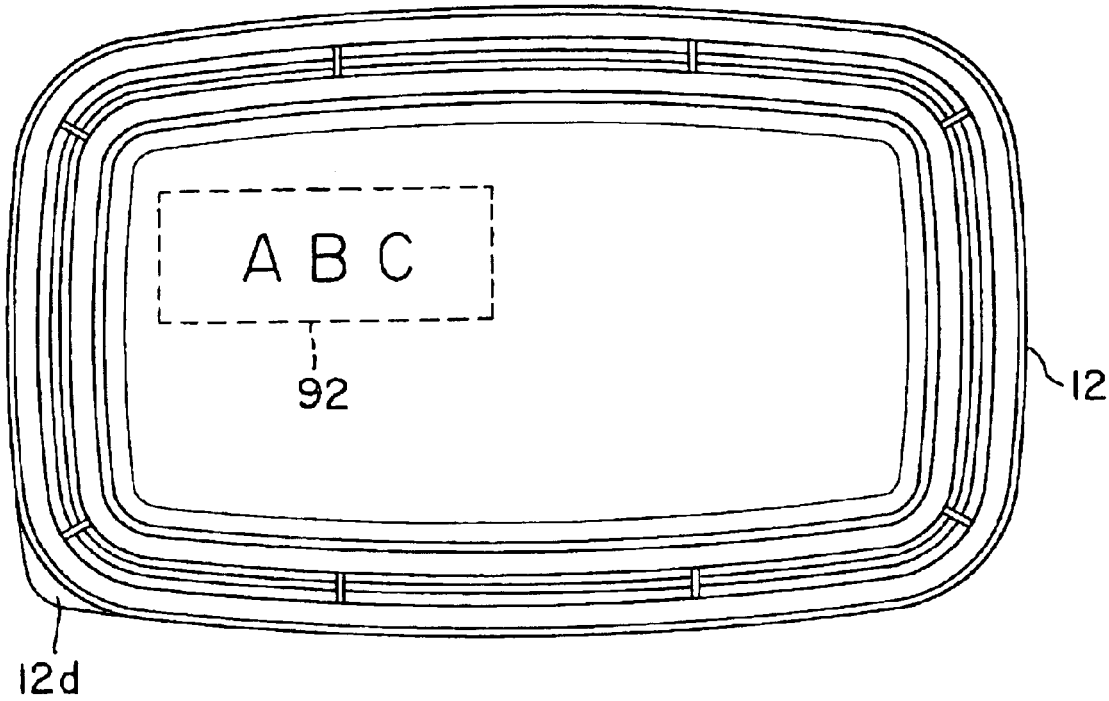
FIG. 22 is a bottom view of a bottom wall included in the container with a hinged lid shown in FIG. 17.

The bottom wall 12 will be described with reference to FIGS. 22 and 23. The bottom wall 12 is formed by the injection molding of a resin and is provided with a label 92 indicating letters as shown in FIGS. 22 and 23. A central part of the bottom wall 12 is raised to prevent the bottom wall 12 from bulging out. The bottom wall 12 is provided with a tongue 12*d*, by which the bottom wall 12 is pulled to separate the same from the container body 11.

Figure 33:
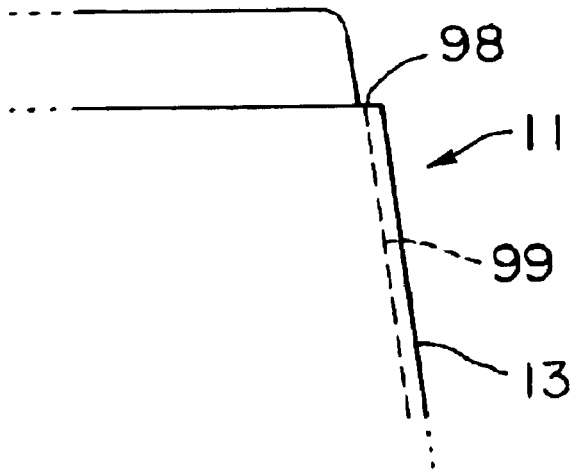
FIG. 33 is a view of a container body having a side wall provided with a shoulder.

A shoulder 98 may be formed in an upper part of the side wall 13 of the container body 11 so as to project downward as shown in FIG. 33. If a label 99 is formed in the side wall 13, the label 99 is inserted in a cavity formed between a male mold 90 and a female mold 91 so that the label 99 is held on a shoulder 91*a* of the female mold 91. Then, a resin is injected into the cavity between the male mold 90 and the female mold 91 to form the side wall 13 of the container body 11. The shoulder 98 of the side wall 13 corresponds to the shoulder 91*a* of the female mold 91.

The operation of the second embodiment thus constructed will be described below.

One end of the rubber plate 50 is inserted in the recess 75 of the container body 11, the other end of the rubber plate 50 is positioned by fitting the projections 78 formed at predetermined positions on the hinged lid 23 in the positioning holes 50*a* of the rubber plate 50, and then the other end of the rubber plate 50 is fastened to the hinged lid 23 with the rubber plate holding member 76.

The sealed pouch 40 containing wet tissues 41 is put in the container body 11 through the open lower end of the same. The joining rib 13*a* of the container body 11 is forced into the groove between the pair of catching ribs 12*a* and 12*b* to cover the open lower end of the container body tight with the bottom wall 12. The joining rib 13*a* of the container body 11 is guided toward the groove between the pair of catching ribs 12*a* and 12*b* by the inclined rib 12*c* of the bottom wall 12 to facilitate work for joining together the container body 11 and the bottom wall 12.

When the hinged lid 23 is moved in a closing direction relative to the container body 11, the locking projection 32 of the hinged lid 23 is caught by the catching projection 33 of the container body 11, and the frame 37 of the hinged lid 23 and the sealing wall 94 of the container body 11 are engaged hermetically to seal a space defined by the frame 37.

When using the wet tissues 41, the finger rest 88 of the horizontal strip 55*b* of the operating device 55 is depressed to release the locking projection 32 from the catching projection 33 by bending the vertical wall 55*a* about its lower edge part 55*c*. Consequently, the swing lid 23 is turned on the pivot shaft 77 in the opening direction by the resilience of the rubber plate 50 and the hinged lid 23 is opened.

Then, the top wet tissue 41 is taken between fingers and is pulled upward to take out the top wet tissue 41 through the opening 24. The top wet tissue 41 is pulled further to take out the same from the container body 11. The lower half 41*b* of the top wet tissue 41 entrains the upper half 41*a* of the second top wet tissue 41. As the top wet tissue 41 is pulled further, the upper half 41*a* of the second top wet tissue 41 spreads from a central region of the opening 24 toward the spaces between the end edges 84 of the first flaps 82 and the end edges 85 of the second flaps 83, and is caught between the first flaps 82 and the second flaps 83.

Thus, the vertical wall 55*a* of the operating device 55 bends about its lower edge part 55*c* when the finger rest 88 of the horizontal strip 55*b* is depressed, so that the locking projection 32 of the hinged lid 23 can directly and surely be released from the catching projection 33 of the vertical wall 55*a*.

As is apparent from the foregoing description, according to the present invention, the hinged lid is opened by the elastic biasing member when the locking projection is released from the catching projection. Since the hinged lid is supported on the side wall of the container body, the hinged lid can be formed in a shape larger than a shape in which the hinged lid can be formed when the hinged lid is supported on the upper wall of the container body. When the hinged lid can be formed in a large shape, the opening of the container body can be formed in a large size accordingly, and the large opening facilitates taking the wet tissues out of the container body through the opening.

What is claimed is:

1. A container with a hinged lid comprising:

a container body having (1) an upper wall with an opening defined therein, (2) a recessed portion along an edge of the opening of the upper wall on a side of a free edge of a hinged lid defined herein, the recessed portion forming a plane below the upper wall, and (3) a side wall integral with and extending in a diverging manner from the upper wall to define an open lower end that is wider than the upper wall;

a bottom wall covering the open lower end of the side wall;

a hinged lid pivotally attached to the container body in the vicinity of the opening, the hinged lid obstructing at least one edge of the opening of the upper wall, the hinged lid positionable to cover the opening of the upper wall;

an elastic biasing means between the hinged lid and the container body, whereby the biasing means urges the hinged lid away from the opening of the upper wall into an open position;

locking means on a free edge of the hinged lid; and a lid operating device provided in the recessed portion, having a latching part facing the interior of the container body, the latching part for engaging the locking means, whereby the latching part releases the locking means when the lid operating device is operated in the recessed portion, thereby moving the latching part away from the locking means, and releasing the hinged lid wherein (a) the recessed portion starts around the free edge of the hinged lid and terminates at the portion of the side wall on the side of the free edge of the hinged lid, (b) the lid operating device has a horizontal strip to be depressed, and cooperating with the latching part, and (c) the horizontal strip is located within the outside shape of the container body so that the horizontal strip is on a plane below the upper wall.

2. The container with a hinged lid according to claim 1, wherein the hinged lid is provided on its base end part with a pivot shaft, the pivot shaft is fitted in bottomed holes formed in the container body.

3. The container with a hinged lid according to claim 1, wherein the hinged lid is provided with a frame protruding toward the container body, and the container body is provided with an inner rib and an outer rib between which the frame of the hinged lid is engaged.

4. The container with a hinged lid according to claim 3, wherein a packing is placed in a space between the inner and the outer rib so that an end edge of the frame comes into contact with the packing.

5. The container with a hinged lid according to claim 1, wherein the hinged lid is provided with a frame protruding toward the container body, and an inclined surface with which the frame of the hinged lid comes into contact, is formed in the container body.

6. The container with a hinged lid according to claim 1, wherein the hinged lid is provided with a frame protruding toward the container body, and the frame is formed integrally with the hinged lid and is made of an elastic material.

7. The container with a hinged lid according to claim 1, wherein the side wall of the container body is provided along a lower end thereof with a joining rib, and the bottom wall is provided with a pair of catching ribs, and an inclined rib for guiding the joining rib toward the pair of catching ribs.

8. The container with a hinged lid according to claim 1, wherein the elastic biasing means is a rubber plate, and the rubber plate is positioned away from the respective middle parts of the container body and the hinged lid toward one side with respect to the middle parts.

9. The container with a hinged lid according to claim 8, wherein the rubber plate is disposed horizontally and fixedly on the container body.

10. The container with a hinged lid according to claim 9, wherein the rubber plate is disposed horizontally on the container body, and is held fixedly in place by a rubber plate holding member attached to the container body.

11. The container with a hinged lid according to claim 1, wherein the hinged lid has a resin body formed by injection molding, and a label incorporated in the resin body.

12. The container with a hinged lid according to claim 1, wherein the inner surface of the hinged lid has reinforcing ribs.

13. The container with a hinged lid according to claim 1, wherein the elastic biasing means is a rubber plate having a first end part fastened to the container body and a second end part fastened to the hinged lid, and the rubber plate is provided in the second end part with a plurality of positioning holes to receive projections formed on the hinged lid, respectively.

14. The container with a hinged lid according to claim 13, wherein the projections are fitted in the positioning holes formed in the second end part of the rubber plate, and a rubber plate holding member is put on the second end part of the rubber plate.

15. The container with a hinged lid according to claim 1, wherein a finger rest projects upward from an edge part of the horizontal strip.

16. The container with a hinged lid according to claim 15, wherein an edge of the finger rest is inclined upward from opposite ends thereof toward a middle part thereof.

17. The container with a hinged lid according to claim 1, wherein a lower part of the vertical wall is connected to the container body by a connecting wall laterally extending from the lover part of the vertical wall.

18. The container with a hinged lid according to claim 1, wherein the horizontal strip is provided with reinforcing ribs.

19. The container with a hinged lid according to claim 1, wherein the horizontal strip is extended from a part of the vertical wall corresponding to the catching part formed on the vertical wall.

20. The container with a hinged lid according to claim 1, wherein the hinged lid is provided with a frame protruding toward the container body, the container body is provided with a sealing wall defining a space for closely receiving the frame of the hinged lid, and an inner edge of an upper end of the sealing wall excluding a section thereof corresponding to the elastic biasing means is beveled to form a chamfer.

21. The container with a hinged lid according to claim 1, wherein the upper wall of the container body is provided on its inner surface with reinforcing ribs to prevent the upper wall from being bent by the elastic biasing means.

22. The container with a hinged lid according to claim 1, wherein the upper wall of the container body is provided with a pair of first flaps extending toward the opening, and a pair of second flaps formed opposite to the pair of first flaps, respectively.

23. The container with a hinged lid according to claim 22, wherein each of the first flaps and the second flaps has a wavy longitudinal section.

24. The container with a hinged lid according to claim 22, wherein free end parts of the first and the second flaps are bent in upwardly concave curves to form round end parts and concave parts are formed in the free end parts of the first and the second flaps so as to extend from the round end parts toward the base ends of the first and the second flaps, respectively.

25. The container with a hinged lid according to claim 22, wherein the pair of first flaps diverge toward free end parts thereof so that a space between the pair of first flaps expands toward the free end parts of the pair of first flaps, and the pair of second flaps diverge toward free end parts thereof so that a space between the pair of second flaps expands toward the free end parts of the pair of second flaps.

26. The container with a hinged lid according to claim 22, wherein end edges of the first flaps, and those of the corresponding second flaps are parallel to each other.

27. The container with a hinged lid according to claim 22, wherein a gap between an end edge of each of the first flap and an end edge of the corresponding second flap is expanded toward the inside.

28. The container with a hinged lid according to claim 22, wherein outer edges of the opening facing the outer side edges of the first flaps and the outer side edges of the second flaps have a shape corresponding to those of the outer side edges of the first flaps and the outer side edges of the second flaps.

29. The container with a hinged lid according to claim 1, wherein the side wall of the container body is provided on its outer surface with a shoulder projecting downward.

30. The container with a hinged lid according to claim 1, wherein the bottom wall has a resin body formed by injection molding, and a label incorporated into the resin body, and is formed by insert molding.

31. The container with a hinged lid according to claim 1, wherein a central part of the bottom wall is raised.

32. The container with a hinged lid according to claim 1, wherein a peripheral part of the bottom wall extends outward from the extended edges of the side wall of the container body.

33. A container with a hinged lid comprising:

a container body having (1) an upper wall with an opening defined therein, (2) a recessed portion along an edge of the opening of the upper wall on a side of a free edge of a hinged lid defined herein, the recessed portion forming a plane below the upper wall, and (3) a side wall integral with and extending in a diverging manner from the upper wall to define an open lower end that is wider than the upper wall;

a bottom wall covering the open lower end of the side wall;

a hinged lid pivotally attached to the container body in the vicinity of the opening, the hinged lid obstructing at least one edge of the opening of the upper wall, the hinged lid positionable to cover the opening of the upper wall;

an elastic biasing means between the hinged lid and the container body, whereby the biasing means urges the hinged lid away from the opening of the upper wall into an open position;

locking means on a free edge of the hinged lid; and a lid operating device provided in the recessed portion, having a latching part facing the interior of the container body, the latching part for engaging the locking means, whereby the latching part releases the locking means when the lid operating device is operated in the recessed portion, thereby moving the latching part away from the locking means, and releasing the hinged lid wherein (a) the recessed portion starts around the free edge of the hinged lid and terminates at the portion of the side wall on the side of the free edge of the hinged lid, the upper wall having a depressed part formed near a free end edge of the hinged lid and an upper end part of the side wall, (b) the lid operating device has a horizontal strip to be depressed, and cooperating with the latching part, and (c) the horizontal strip is located within the outside shape of the container body so that the horizontal strip is on a plane below the upper wall.

* * * * *

UNITED STATES PATENT AND TRADEMARK OFFICE

CERTIFICATE OF CORRECTION

PATENT NO. : 6,951,292 B2
DATED : October 4, 2005
INVENTOR(S) : Takeshi Bando et al.

It is certified that error appears in the above-identified patent and that said Letters Patent is hereby corrected as shown below:

Title page,
Item [22], PCT. Filed, should read -- October 14, 1998 --.

Signed and Sealed this

Twenty-first Day of February, 2006

JON W. DUDAS
*Director of the United States Patent and Trademark Office*